US008773261B2

(12) United States Patent
Bowers

(10) Patent No.: US 8,773,261 B2
(45) Date of Patent: Jul. 8, 2014

(54) MEDICATION MANAGEMENT APPARATUS AND SYSTEM

(76) Inventor: Betty L Bowers, Beachwood, OH (US)

( * ) Notice: Subject to any disclaimer, the term of this patent is extended or adjusted under 35 U.S.C. 154(b) by 0 days.

(21) Appl. No.: 13/558,542

(22) Filed: Jul. 26, 2012

(65) Prior Publication Data

US 2013/0024022 A1 Jan. 24, 2013

Related U.S. Application Data

(63) Continuation of application No. 12/628,361, filed on Dec. 1, 2009, now Pat. No. 8,253,561.

(60) Provisional application No. 61/185,816, filed on Jun. 10, 2009.

(51) Int. Cl.

| | |
|---|---|
| ***G08B 21/00*** | (2006.01) |
| ***A61J 1/03*** | (2006.01) |
| ***A61J 7/04*** | (2006.01) |
| ***A61J 7/00*** | (2006.01) |

(52) U.S. Cl.

CPC .... *A61J 7/04* (2013.01); *A61J 1/03* (2013.01); *A61J 7/0409* (2013.01); *A61J 2007/0436* (2013.01); *A61J 7/0084* (2013.01)

USPC ..... 340/540; 340/309

(58) Field of Classification Search

USPC ..... 340/540, 316, 309, 538; 206/534, 538

IPC ..... G06F 1/00; A61J 1/00

See application file for complete search history.

(56) References Cited

U.S. PATENT DOCUMENTS

| | | | | |
|---|---|---|---|---|
| 2002/0078947 | A1* | 6/2002 | Gumaste | 128/200.14 |
| 2007/0295636 | A1* | 12/2007 | Rivero | 206/538 |
| 2008/0277307 | A1* | 11/2008 | Mazur | 206/534 |
| 2009/0206100 | A1 | 8/2009 | Mazur | |

OTHER PUBLICATIONS

Office Action dated Dec. 27, 2011 for U.S. Appl. No. 12/628,381, 17 pages.

* cited by examiner

*Primary Examiner* — Shirley Lu

(74) *Attorney, Agent, or Firm* — Amin, Turocy & Watson, LLP

(57) ABSTRACT

The invention relates to an apparatus, system and method for managing medication. In an aspect, an adaptable pill organizer comprises of at least one or more rectangular units for containing pills. Individual units and/or rows of seven units-attach and detach from one another in order to create a custom pill organizer. The adaptable pill organizer further employs electronic capabilities which: allow user to input, store and display information on the pill organizer; provide lighting means for the device; provide various automatic and/or commanded physical responses to usage of the device such as the lighting of a unit, or the opening and closing of a unit; provide programmed alarms; communicate data messages and usage information with third party devices; and store and provide access to user medication and medication schedule information.

4 Claims, 19 Drawing Sheets

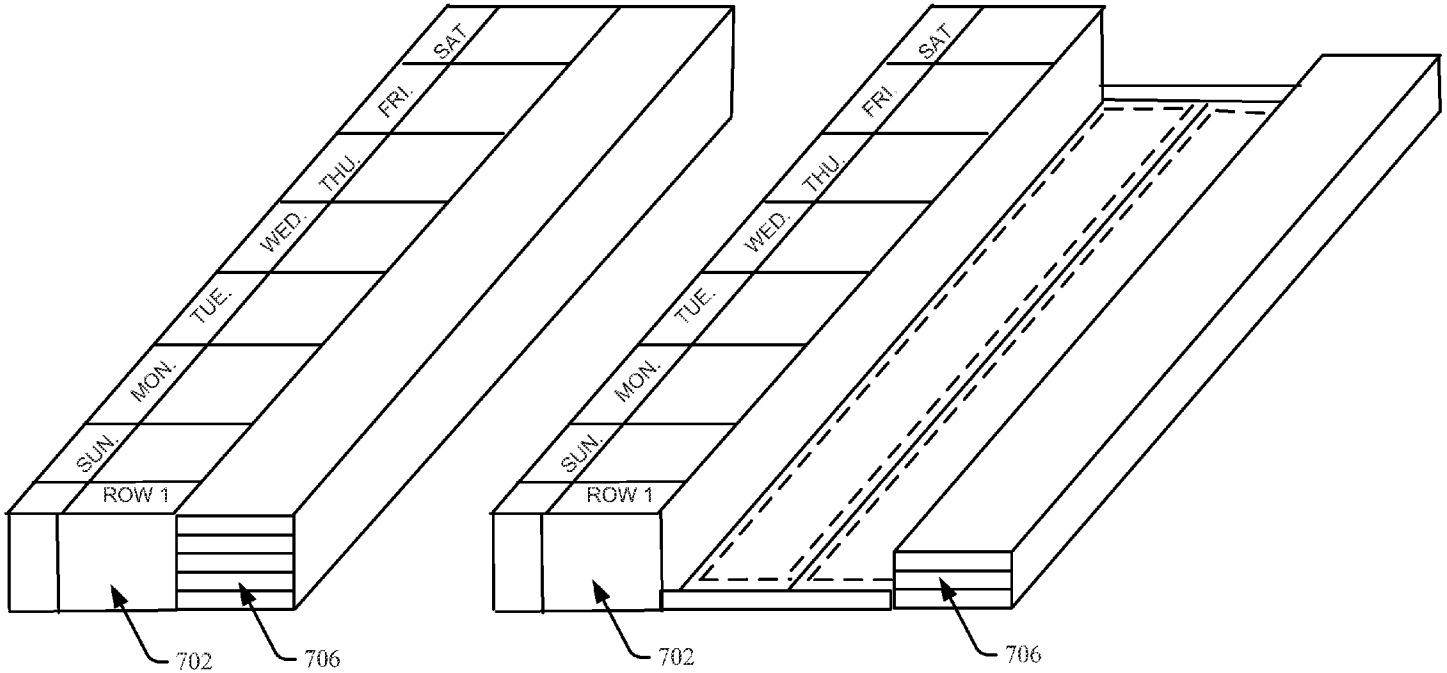
FIG. 8A
FIG. 8B
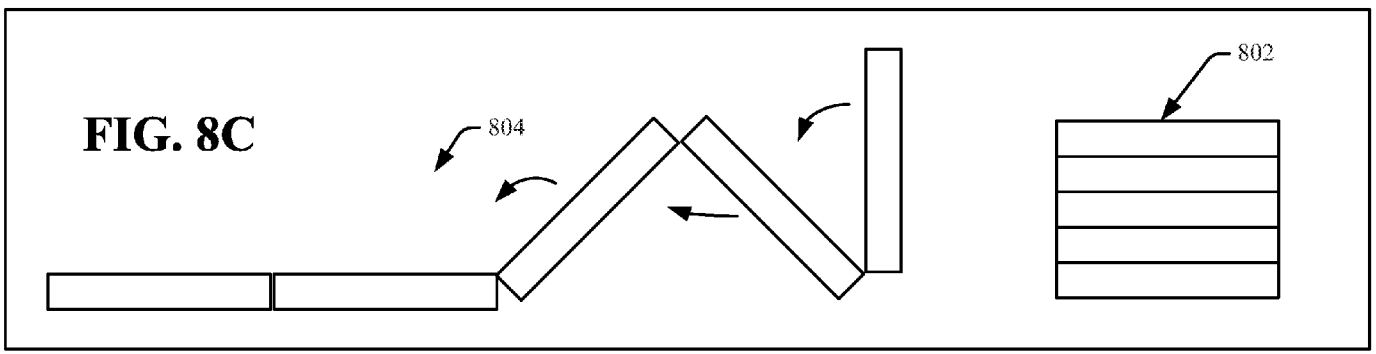
FIG. 8C

MEDICATION MANAGEMENT APPARATUS AND SYSTEM

CROSS-REFERENCE TO RELATED APPLICATIONS

This patent application is a continuation of U.S. patent application Ser. No. 12/628,361, filed on Dec. 1, 2009, entitled MEDICATION MANAGEMENT APPARATUS AND SYSTEM, which claims the benefit of U.S. provisional patent application Ser. No. 61/185,816 filed, Jun. 10, 2009. These patent applications are incorporated herein by reference.

FIELD OF THE INVENTION

The present invention relates to an apparatus, system and method for managing medication. In particular, the invention relates to an adaptable pill organizer, and a computer implemented system and method employed in conjunction with the adaptable pill organizer, for managing and monitoring a self-medication regime.

BACKGROUND

Many individuals take multiple pills throughout the day. Often times an individual takes various pills according to a specific schedule wherein the individual takes certain pills on particular days and at specific times. The act of organizing and regulating a medication regime becomes quite cumbersome to manage as the number of pills increases and the medication schedule become more complex.

Several pill boxes exist which provide various configurations of compartments for organizing pills. For example, pill boxes are available with a single row of seven compartments connected and aligned side by side. The seven compartments are generally labeled for a day of the week so that a user can place all the pills for a specific day in the allocated compartments. In addition, other pill boxes are available which consist of several square compartments arranged like a grid with seven compartments across as described above and additionally one or more compartments extending downward. Accordingly, the entire pill box consists of seven columns and one or more rows. At each column and row intersection point there is a compartment for pills. These types of pill boxes are generally used to designate each compartment to hold pills required to be taken at particular time of day and at a specific time. For example, a user may purchase a pill box with columns for the seven days of the week and with four rows. A user can further label each row with a time of day and organize the pills according to the established grid.

However, all of the pill boxes available have a fixed number of compartments. As a result, a user is often forced to adapt his medication organization method to accommodate the fixed dimensions of the pill box. For example, if a user cannot properly organize his pills in one pill box, often times he or she must purchase another pill box and forgo the convenience of containing all his pills in one pill box. Similarly, a user may purchase a pill box with several rows of compartments in anticipation of their future necessity. However, in the meantime, the user must carry around a larger and inconvenient pill box. Further, if a user desires to separate the pills for a weekend, a user will often need to put the pills in a new pill box.

SUMMARY OF THE INVENTION

The following presents a simplified summary in order to provide a basic understanding of some aspects of the disclosed embodiments. This summary is not an extensive overview and is intended to neither identify key or critical elements nor delineate the scope of such embodiments. Its purpose is to present some concepts of the described embodiments in a simplified form as a prelude to the more detailed description that is presented later.

Disclosed are device(s), system(s), and method(s) for managing, regulating and monitoring a medication regime. In particular disclosed is an adaptable pill organizer that includes several units for containing pills. Similar, to conventional pill boxes, the adaptable pill organizer allows for a user to associate pills for a specific day and time of day within an assigned unit. However, unlike conventional pill boxes, the adaptable pill organizer comprises one or more units for containing pill(s) which can be pieced together to create a customized pill box of a desired configuration.

In one embodiment, an adaptable pill organizer comprises two or more rectangular units that transiently attach. Some of the units comprise an extended structure that serves as a platform for a label. Accordingly, the user can align units to create a row of seven across and designate each unit for a day of the week. A user can further attach units in a direction downward from the initial seven units in order to create more rows of seven units. The initial unit used to create a row consists of an extended material that provides a platform for the user to label the row for a time of day. In another embodiment, an adaptable pill box consists of a fixed primary row of seven units labeled for the days of the week and several attachable fixed standard rows of seven consecutive units. The standard rows can be labeled for a time of day. Accordingly, an adaptable pill organizer allows a user to create a pill box with as many rows and units as desired. Further, the user can detach, rearrange, and/or reattach, any segment of the pill box.

In another embodiment, the adaptable pill organizer includes electronic features and elements. In particular, in this embodiment, the adaptable pill organizer employs an interface component that allows a user to interact with the device. The interface component can include but is not limited to the following features: an LCD screen, a touch LCD screen, buttons, dials, and/or a speaker. In addition, the electronic pill organizer includes a computer capable of storing information related to a user including but not limited to, the user's medication needs, medication schedule and related information. The computer further directs and controls various functionalities of the device. The electronic pill organizer provides several additional features over a standard non-electronic pill box. These features include but are not limited to: allowing a user to input, store and view information; lighting the device; providing various automatic and/or commanded physical responses to usage of the device such as the lighting of a unit, or the opening and closing of a unit; providing programmed alarms; communicating data messages and usage information with third party devices; and storing and providing access to user medication and medication schedule information.

Included within the electronic adaptable pill organizer is a power source and the related circuitry required to run the device. Each unit is further provided with either a light or an LCD screen and the associated electrical circuitry. The attachment means of each unit and/or row allows each unit to electrically connect to one another so that when a unit connects to the primary row directly or indirectly, an integrated circuit is established throughout the device. Further the units and/or the attachment means for the units includes sensors. The sensors allow the electronic pill organizer to detect at least the following and respond accordingly: when a unit is attached or detached, when a unit is empty or full, and when a unit is opened or closed. The electronic pill organizer can further sense the physical characteristics of the medication within each unit such as the number and type of pills. Furthermore, the electronic pill organizer comprises a means for wired and/or wireless communication to other devices.

Further disclosed is a system and method for regulating a self-medication regimen. In one embodiment, the system is employable on the aforementioned electronic pill organizer. In another embodiment, the system is employable on the electronic pill organizer in conjunction with a third party device. The system includes a sensor component associated with the electronic pill organizer that detects physical changes in a unit and user interaction with a unit. The system further comprises a message generation component that generates a message in response to information gathered by the sensor component; and a message interpretation and display component that interprets a message generated by the message generation component and establishes an appropriate response. For example, a response can include the display of information on the LCD of the pill organizer, an audio response, the storage of information in a storage component of the LCD, the lighting or opening and closing of unit, or the sending of a message to a third party device.

The system allows the electronic pill organizer to exchange messages between devices. The messages can be generated by the electronic pill organizer and sent to a third party device. For example, the messages can be generated in response to sensed information as described above, or the messages can be generated by the user of the electronic pill organizer through the input of information into the device. A third party device receives a message from the electronic pill organizer and the message can be viewed or the message initiates a physical response in the third party device. In another aspect, the messages are generated by the third party device and sent to the electronic pill organizer. Accordingly, the system allows a third party to monitor, regulate, and assist in the task of managing a self-medication regime. Third party devices capable of utilizing the subject system include but are not limited to: cellular phones, PDAs, PCs, laptop computers, interactive TVs, tablet PCs, etc.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

BRIEF DESCRIPTION OF THE DRAWINGS

FIG. 8 illustrates an embodiment of and adaptable pill organizer with a base sheet and the manner in which a base sheet folds and unfolds in order to provide space to attach a row and/or a unit.

DETAILED DESCRIPTION

Disclosed are device(s), system(s), and method(s) for managing, regulating and monitoring a medication regime. Various embodiments are now described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form in order to facilitate describing these embodiments. The word "exemplary" is used herein to mean serving as an example, instance, or illustration. Any aspect or design described herein as "exemplary" is not necessarily to be construed as preferred or advantageous over other aspects or designs.

It is to be appreciated that the various drawings are not drawn to scale from one figure to another nor inside a given figure, and in particular that the size of the components are arbitrarily drawn for facilitating the reading of the drawings. Although the various embodiments and features are shown in two dimensions and three dimensions, it should be understood that such a depiction merely facilitates clarity and that the features and components referred to herein are three dimensional. In the following description, for purposes of explanation, numerous specific details are set forth in order to provide a thorough understanding of the present invention. It may be evident, however, that the present invention may be practiced without these specific details. Further, a combination of the various features and approaches may also be used.

Figure 1:
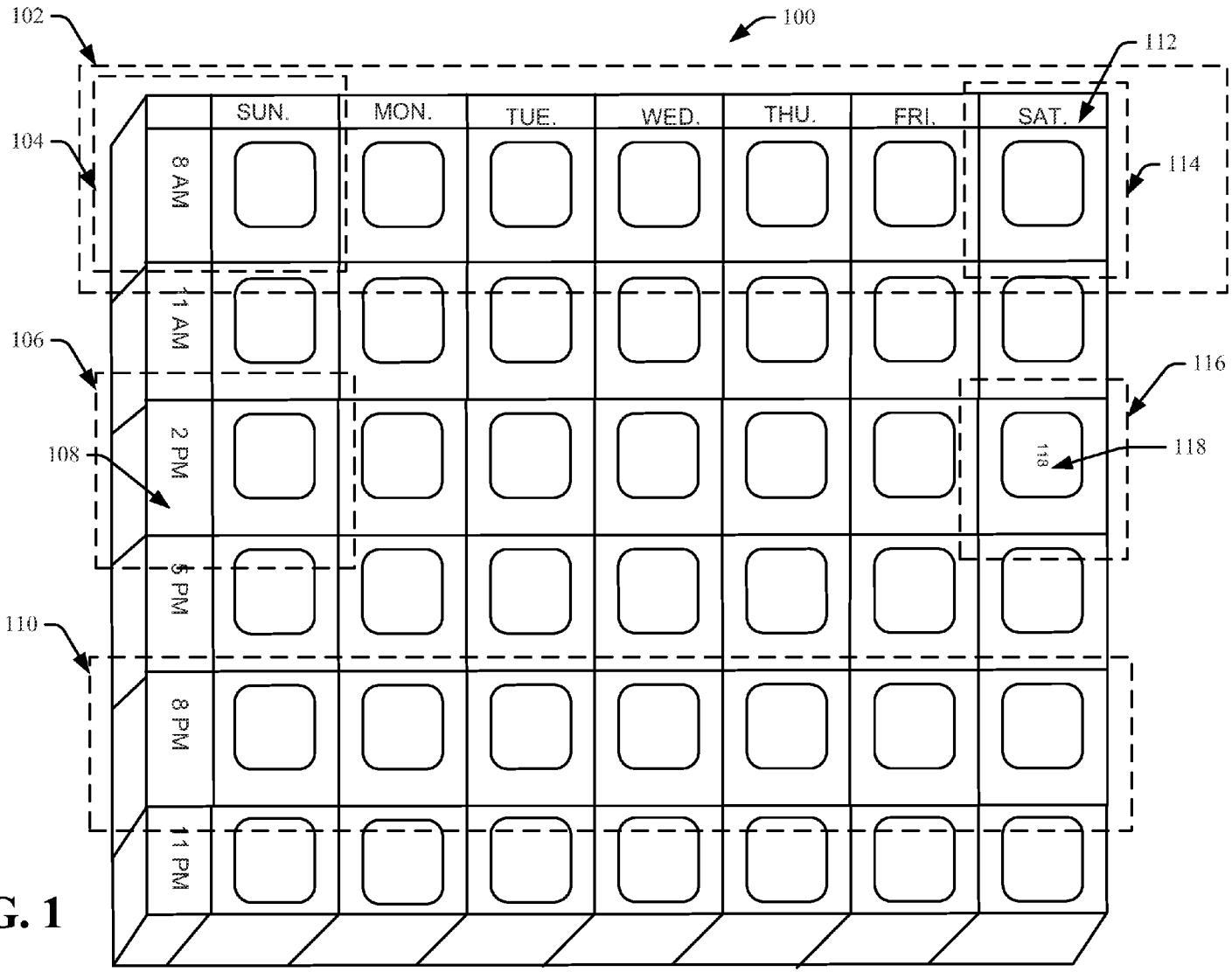
FIG. 1 illustrates an adaptable pill organizer in accordance with the subject invention.

FIG. 1 illustrates an exemplary embodiment of an adaptable pill organizer (APO). Presented is a container for holding pills with several pill holding units. Unit 116 is a standard pill unit and includes a receptacle 118 for holding pills. Various embodiments of a standard pill unit as well as the other types of pill units will be described infra. At 106 is a row starter unit. A row starter unit includes the basic structure of a standard unit with the additional feature of an extended portion 108 that provides an area for a label upon which a time or other type of heading, can be displayed. It should be appreciated that an individual unit can employ a wide variety of labels in order to design an APO for a particular organizational scheme. For example, a user can designate each row for a particular family member and/or each column for a particular type of pill. However, for simplicity, as used herein, a row starter unit will be labeled for a particular time and a column starter unit will be labeled for a specific day. At 114 is a column starter unit. A column starter unit includes the basic structure of a standard unit with the additional feature of an extended portion 112 that provides an area for a label upon which the day of the week or other heading can be displayed. At 104, depicted is a pill unit that has the features of both a row starter unit and a column starter unit. As used herein, a pill unit, regardless of the type as described above, refers to an individual compartment designated to hold pills.

The APO 100 depicted in FIG. 1 presents 42 pill units arranged 7 across and 6 down. However, as will be described infra, an APO can be manually manipulated to include as few as one unit to as many units as an individual desires and the units can be arranged in any configuration. For example, an APO can include enough units for taking pills seven days a week at ten times a day, which equates to a configuration of seventy pill units arranged 7 across and 10 down. In another embodiment, an APO is not limited to any number of pill units. Further, an APO is not limited to any particular dimension. An APO can accommodate any number of units across and any number of units down. For example, an APO can be 15 units across and 3 units down.

Full rows of seven units, are depicted at 102 and 108, wherein each unit included in row is labeled for a specific day of the week. The row at 102 is a primary row. The primary row includes seven column starter units wherein the first unit in the row is also a row starter unit. As will be described, an APO can include a fixed primary row wherein each of the units establishing the row are permanently unified. Alternatively, the APO can include the units required to create a primary row wherein each of the units establishing the row are provided individually and each of the units can transiently attach to one another in order to create a primary row. The row at 108 is a standard row. A standard row consists of six standard units and one row starter unit at the end of the standard row. Like the primary row, an APO can include a standard row wherein each of the units establishing the row are permanently unified, or wherein each of the units establishing the row are separable.

Figure 2:
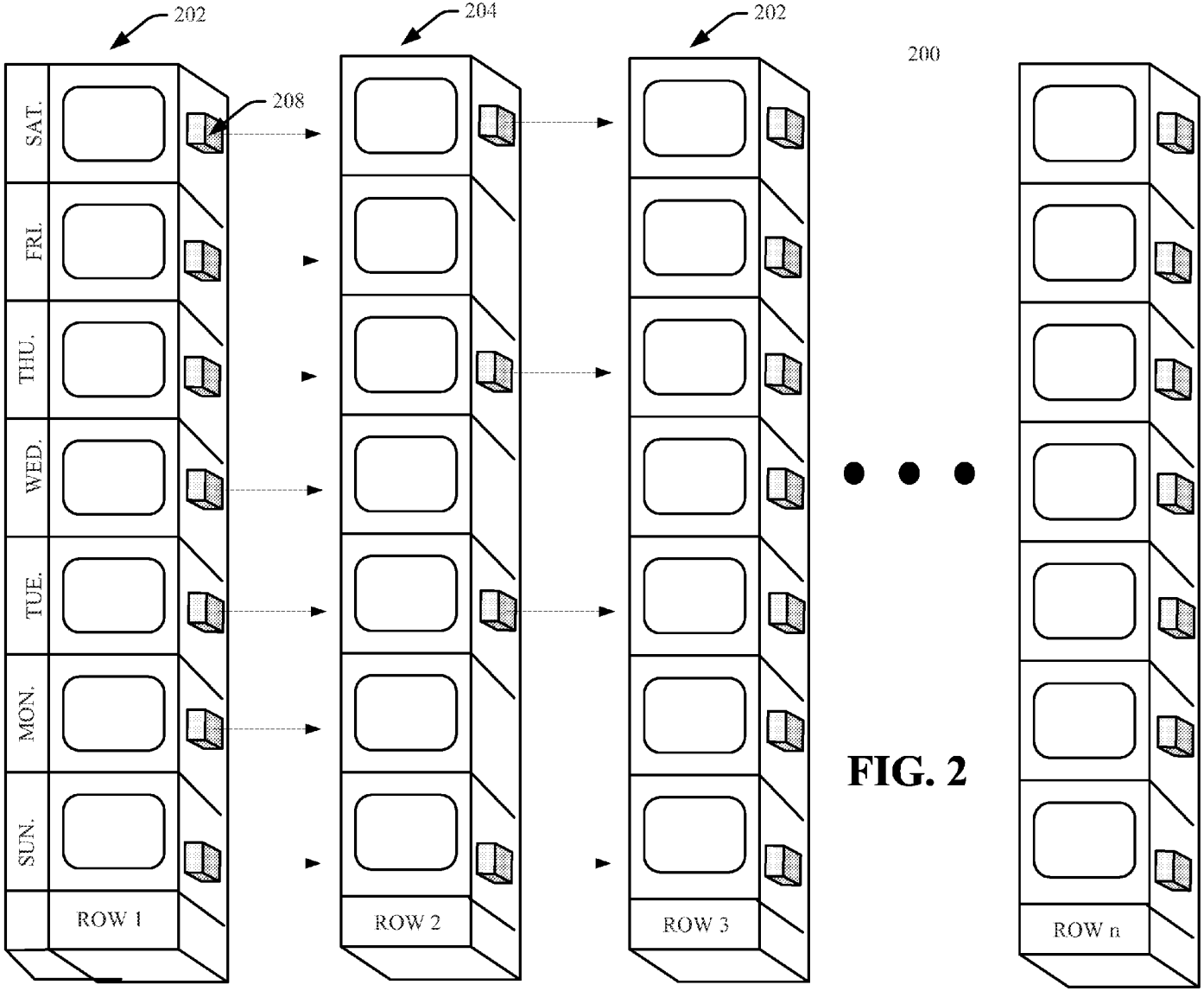
FIG. 2 illustrates another example of an adaptable pill organizer wherein one or more permanently attached rows connect.

Referring now to FIG. 2, depicted is an embodiment of an APO 200 in which some of the units compromising the APO are provided in separated form. FIG. 2 further presents a manner in which the several units can attach together. At 202 is a primary row, and at 204 is a standard row. In this embodiment, both the primary row and the standard row are provided in a form wherein each of the seven units constituting the row are permanently unified. Depicted at 108 is a peg on the end of a unit. Looking ahead to FIG. 6A, a unit can be provided with peg on one side and a slot on the opposite side, such that two units can snap together in a semi-permanent state. The peg of one unit can snap into the opening or slot of another unit. This mechanical attaching mechanism is similar to the manner in which the popular building blocks toy Lego's™, attach together. As will be described infra, several additional mechanisms can be employed in order for one unit or row of an APO to transiently attach to another unit or row respectively.

In FIG. 2, each unit of the primary row 202 includes a peg 208. Each unit of the standard row 204 includes a slot (not shown) for each of the pegs of the primary row to fit into. In order to create the APO depicted in FIG. 1, one primary row and five standard rows attach to one another by snapping the pegs of one unit into the reciprocal slots of another unit. Accordingly, in this embodiment a pill organizer with fixed dimensions of 7 column units across can expand downward to accommodate as many rows as a user desires. In another embodiment, although not depicted, two or more rows can attach side by side in order to create column dimensions in multiples of seven. Further, as described infra, individual units can attach side by side in order to create column dimensions with any number of units.

As shown in FIG. 2, when the rows consist of permanently connected units, each unit can include a peg and slot. Alternatively, as depicted by row 208, only a few rows may require pegs and reciprocal slots. Alternatively, the rows and/or units can fit together in a manner depicted in FIG. 6C. In FIG. 6C, one side of a unit has a track while the other side of a unit has a rail designed to fit into the track of the other unit. In this embodiment, two units would fit together by sliding the rail of one unit into the track of another. When a row comprises seven permanently connected units, a track and/or rail can extend the entire length of the row. In another embodiment, the units and/or rows can be magnetic and attach by way of the magnetic force pulling two units and/or rows together. In another embodiment, a unit connects to another via a ball and socket mechanism.

It should be appreciated that a variety of attaching mechanisms between units and/or rows can be employed that are in accord with the present invention. The rows and/or units attach to one another in a manner in which they will not easily separate when transporting and holding the APO. Further, the attachment mechanism employed does not make it too difficult for those with weak hands, (such as a person suffering with arthritis), to easily manipulate the APO. A variety of attachment mechanisms exist and are in accordance with the subject APO which provide a balance between the ease of manipulation and the strength of attachment between the units/rows.

In an exemplary embodiment, an APO is provided as a primary row with several additional standard rows packaged separately. A primary row includes an attachment mechanism only on one side while the opposite side is smooth. Beginning with the primary row, a user can organize the pills to be taken on the seven days of the week. If however a user is required to take more than one pill a day and at different times, a user can add an additional standard row to the primary row in order to create a pill box with two rows corresponding to the two times of day in which the pills are to be taken. Each time a user is required to take another pill at a different time of day, the user can simply add an additional row. Accordingly, an APO can be easily manipulated to conform to a user's medication schedule. For example, a user can design a pill box with three rows corresponding to pills to be taken at 9 am, 3 pm, and 8 pm. If a user receives a new prescription requiring them to take an additional pill at 12 pm, the user can simply separate the first two rows and insert an additional row to account for the new medication. All the rows can consist of the same or similar dimensions in order to easily fit together and provide a resulting APO in the shape of rectangle.

Because an APO can easily adapt to fit ones medication needs, it should be appreciated that an APO can be a useful tool in managing ones self-medication regime. In addition, pharmacists and medical caregivers can utilize an APO when providing medication to patients. For instance, a pharmacists can deliver medication to a patients pre-organized within an APO. Thus, the pharmacist himself can fill the pillbox. A user patient may request the service from the pharmacist for an additional fee and in turn purchase the APO and filling service. Each time a patient requires a new prescription or refill, the patient can simply bring the APO to the pharmacist for the appropriate filling and/or reorganization. The pharmacist can look up a patient's medical information via a computerized system or simply rely on a paper copy of a medication tablet which is stowed within the pill box as discussed infra with regards to FIG. 4B. The pharmacist can also insert a new medication tablet into the pill box each time the pharmacist refills and/or reorganizes the APO.

Referring back to FIG. 2, in this embodiment, the APO comprises a primary row and a fixed amount of separate standard rows. Further, if the rows/units are attached by way of a peg and slot mechanism or rail and track mechanism, one of the standard rows provided can include only an attachment part on a single side and can serve as an end piece. In the event additional rows are needed, extra rows can be packaged and sold separately.

Figure 3:
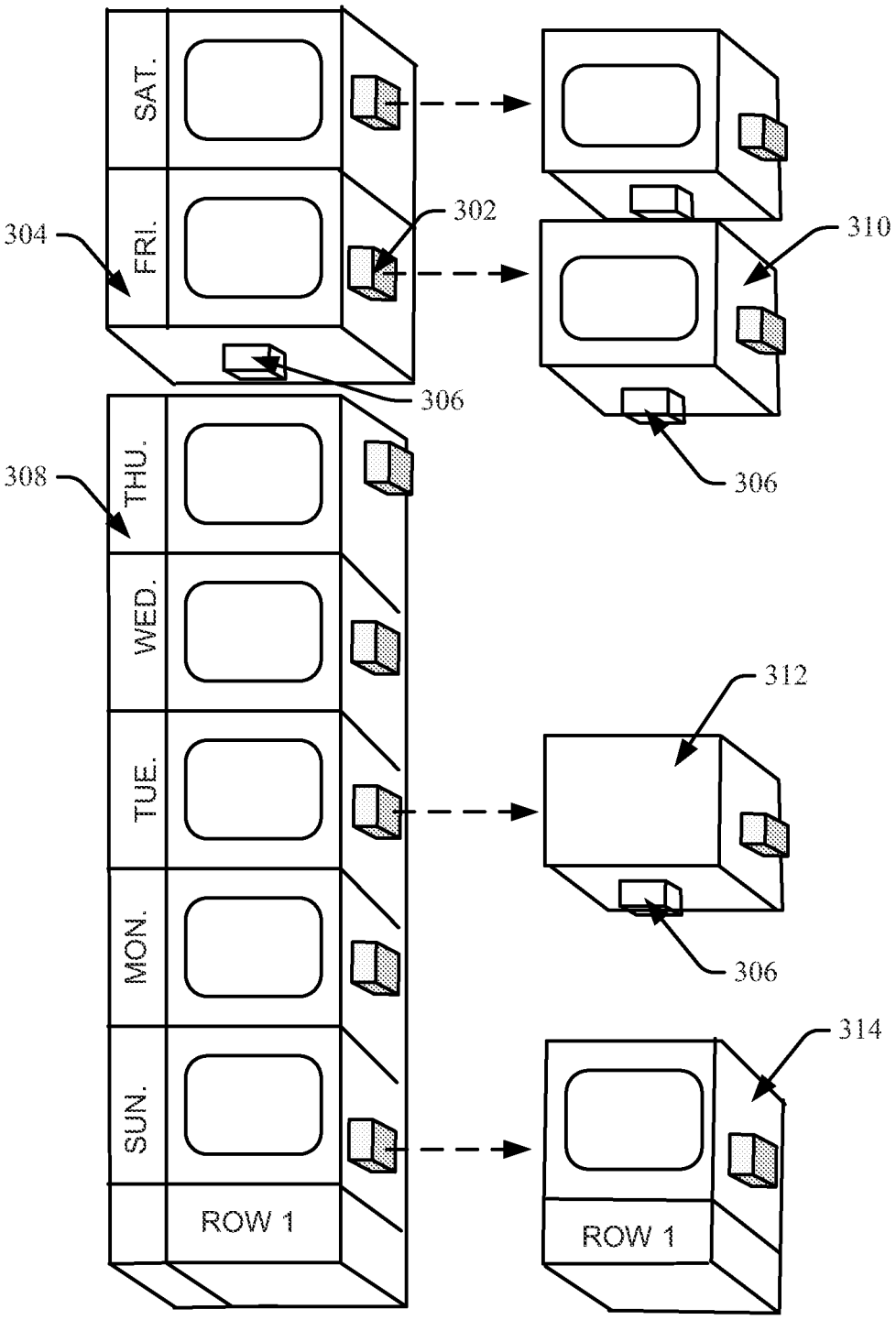
FIG. 3 illustrates another example of an adaptable pill organizer wherein one or more individual units connect to form a pill organizer.

Referring now to FIG. 3, presented is an alternative embodiment of an APO comprising several separated units. In this embodiment, a user can construct his or her own custom pill box by piecing together each unit like building blocks. At 304 is a column unit. In addition to peg 302 on the front of the unit, column unit 304 includes a peg 306 on the left side of the unit that allows column units 304 and 308 to fit together. Unit 308 has a slot on the right side of the unit 308 (not shown) for the peg of unit 306 to fit into. Similarly, standard unit 310 has a peg 306 on the left side and on the front side, and row starter unit 314 has a peg on the front side and a slot on the right side of the unit (not shown). Thus, a unit can have side to side and top to bottom to bottom attachment capabilities. Further, although the APO in FIG. 3 has 7 units attaching side by side in order to create a row, it should be appreciated that any number of units can attach side by side in order to create a row. Accordingly, a user can design an APO with enough attached units in order to accommodate an entire months worth of pills.

A variety of mechanisms can be employed in accordance with the invention in order to allow for the semi-permanent attachment of units, including the rail and track mechanism and magnet mechanism discussed supra. As used herein, semi-permanent attachment refers to attachment wherein two or more units/rows attach to from a stable unified structure that does not separate unless a user applies force. In this embodiment, a user can create the APO depicted in FIG. 1 by piecing together each of the units. Further, if a user desires, the user can separate columns of the APO. For example, if a user desires to take a trip and carry along only the pills required for a Saturday and Sunday, the user can simply detach the Saturday and Sunday columns.

In addition, the APO can provide one or more filler units 312. The filler unit can simply consist of a hollow box with the same attachment capabilities of the units described above; however, the filler units do not have a receptacle to hold any pills. A filler unit can be used to fill a space in the construction of an APO at a time of day when no pills are required to be taken. For example, a user may only need to take a certain pill every other day. Accordingly, rather than constructing a row for a week with three or four empty units, a user can simply include a filler unit. Such an arrangement can reduce confusion and mistakes when taking medication on a regular schedule.

Continuing with FIG. 3, in this embodiment, the APO can consist of several individual units. In this embodiment, the APO would come packaged with seven column starter units, wherein one column starter unit is a both a column starter unit and a row starter unit. In addition, the APO would include several row starter units and several standard units. At least one of the row starter units and six of the standard units provided would have an attachment means on only one side to serve as an end piece. In the event additional units are needed, extra units can be packaged and sold separately.

Figure 4A:
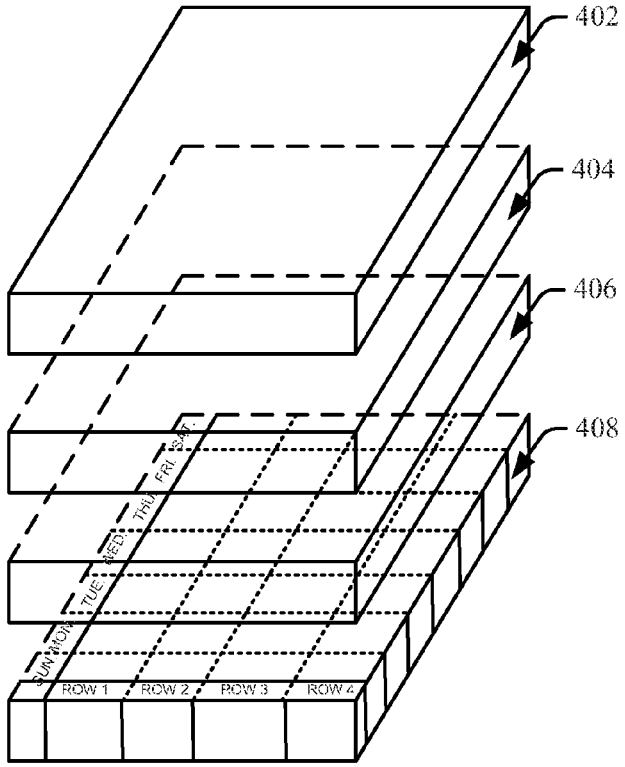
FIG. 4A illustrates an example of how one or more adaptable pill organizers stack and attach to one another.

Looking now at FIG. 4A, presented are four APO's 402-408 stacked on top of one another. In this embodiment, each of the APO's 402-408 resembles the APO 100 shown in FIG. 1. Further, the APO in FIG. 1 can include the characteristics and elements discussed with reference to FIGS. 2 and 3. In this embodiment, a single APO, regardless of the size or shape, has the ability to stack upon another APO of similar shape and size. The perimeter of each APO on the top and bottom can include a mechanism for one APO to link and attach to the other so that when two APO's are stacked they do not easily separate. For example, an APO can include a trench line around the top perimeter of its bodice. The top of the APO includes the lids of each unit or row as described s, and the extended portion of the row starter units and column starter units. The bottom area of the bodice of the APO can further employ a ridge to fit into the trench line. With this arrangement, a user can stack several APO's together such that a user can keep a several week supply of pills together. For example a user can stack two APO's together and have a two weeks supply or stack four or five weeks together. In another embodiment (not depicted), two or more created APO's can attach side by side or top to bottom. For example, a user may create 4 APO's with 7 columns for the days of the week and 3 rows each. A user can further attach all 4 APO's together such that the resulting structure is a large rectangular box with 12 rows down.

Figure 4B:
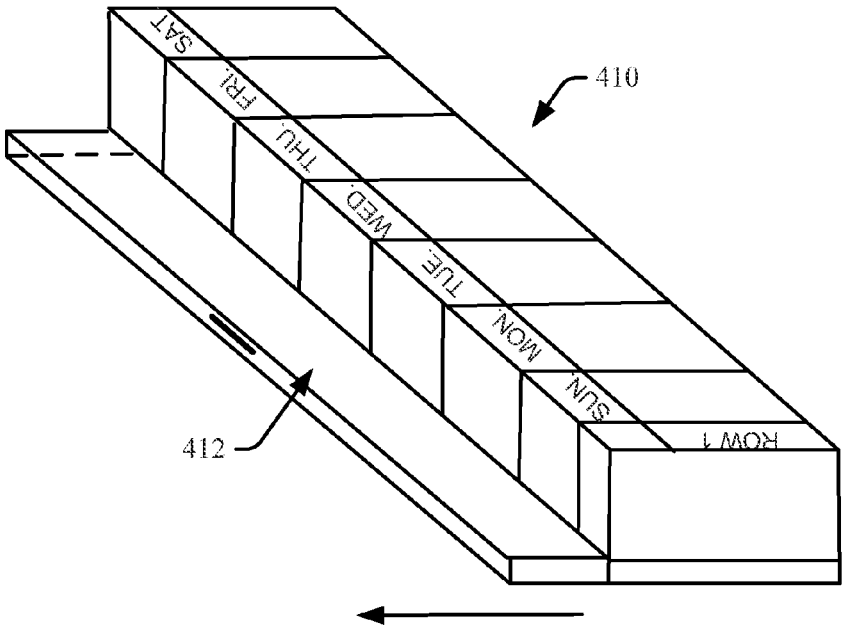
FIG. 4B illustrates a primary row of an adaptable pill organizer with a medication tablet tray.

FIG. 4B depicts another embodiment of a primary row 410 with a pull out structure 412 beneath the row. The structure is in the form of a shallow drawer, or a sheet of plastic or metal that slides in and out of the primary row. As a shallow drawer, the structure 412 provides a compartment in which a user can insert and contain a paper copy of medication information. For example, the drawer can hold a medication chart or tablet that includes all the information pertaining to the medication contained within the entire pill organizer such as: the user's medication schedule, the types of pills contained within the box, the physical features of the pills, when refills are needed, etc. The chart can be used to help the person who fills the units, help the person who is taking the pills to know if all are there and correctly organized, and provide convenient access to pertinent information for medical personnel. In another embodiment, the structure 412 is a sheet of material such as an eraser board. The structure allows a user to write medication information directly onto the board. Further, in another embodiment, although not depicted, an APO can provide a slot on the backside of the structure that allows a user to insert a medication chart.

Figure 5:
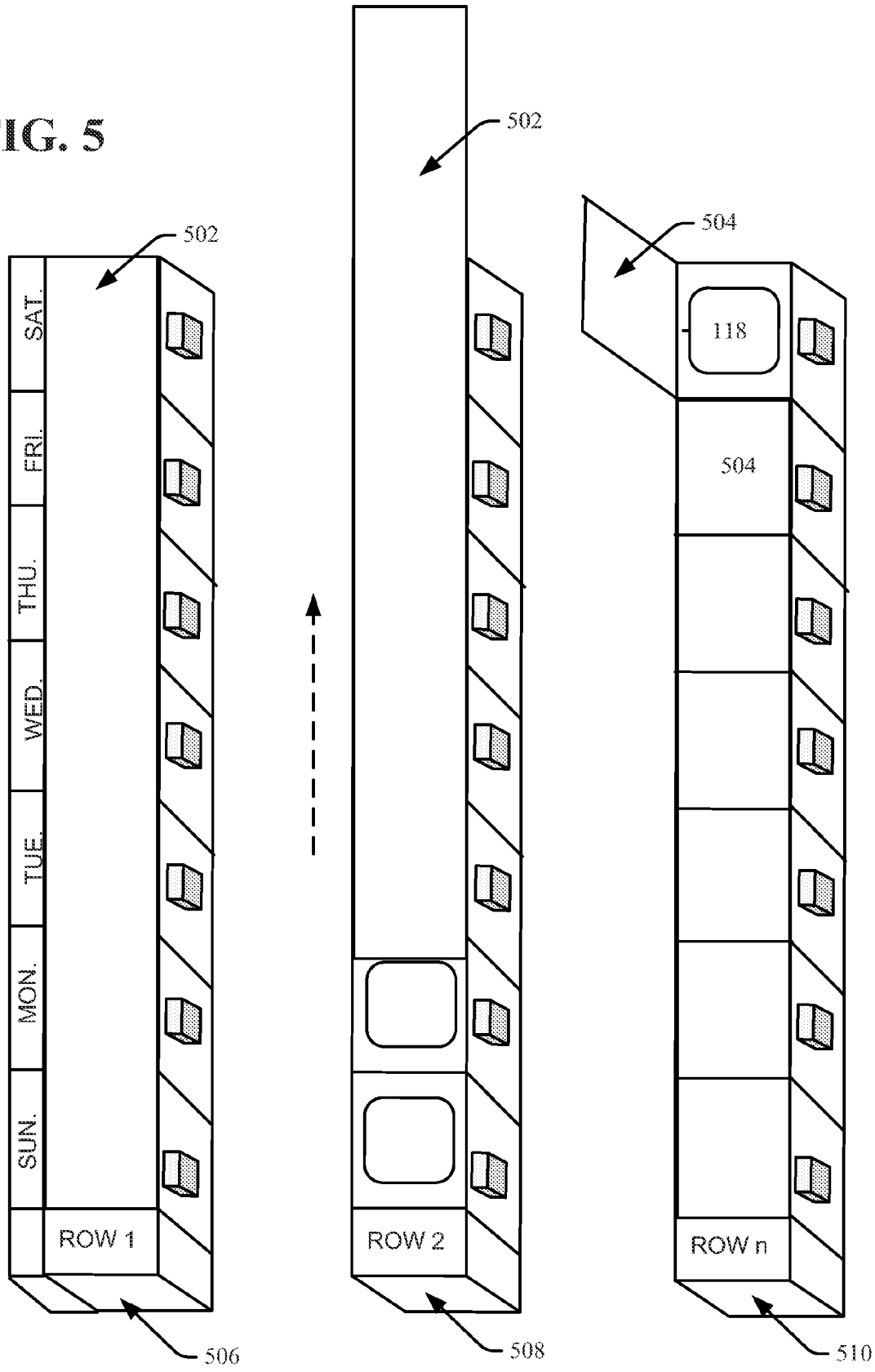
FIG. 5 illustrates the various embodiments of lids employed by fixed rows and individual units of an adaptable pill organizer.

Referring to FIG. 5, depicted are three rows each with units and their respective lids. At 506 is a primary row with a sliding lid 502 completely covering all seven units of the row. The sliding lid is employed in conjunction with a track (not shown) that sits on the top of each unit. In one embodiment, the track does not add to the width of a unit. Accordingly, two rows can easily connect to one another without interference by the lid. It should be appreciated that several types of sliding lids can be employed that are in accordance with the present invention. However, a lid should snap securely in place and allow a user to easily open and close the lid. At 508, is a standard row employing a sliding lid. The reference at 508 demonstrates how a sliding lid opens in the direction of the arrow. However, a sliding lid can open in one direction or bi-directionally. In this embodiment, both rows 506 and 508 consist of seven units that are permanently connected. At 510, presented is another embodiment of a standard row wherein each unit employs its own lid 504. The lid 504 can open and close via any suitable joint mechanism, such as a hinge. However, the lid 504 should be both easy to open and remain tightly closed such that pills do not spill when the APO is transported. When an APO employs units in completely separated form such as those described with respect to FIG. 3, each unit can employ a lid similar to lid 504.

Although not shown, the lids can be labeled with a description of the contents therein. For example, a label can be provided on the topside or underside of the lid. The label can describe the user's medication schedule, the types of pills contained within a unit, the physical features of the pills, when refills are needed, etc. The labels can be used to assist in filling the units and reinforce proper adherence to the user's medication schedule. In one aspect, the label is a sticker that the user can write upon and place on a lid. In another aspect, the label is a magnet with an erasure surface that the user can write upon and place on a lid.

Figure 6A:
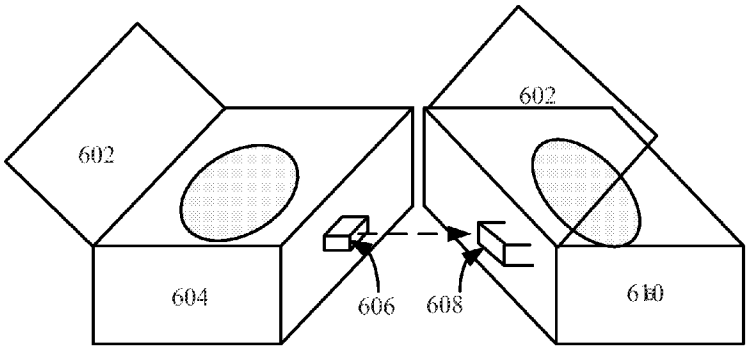
FIG. 6 illustrates the structure and attachment means of various adaptable pill units.
Figure 6B:
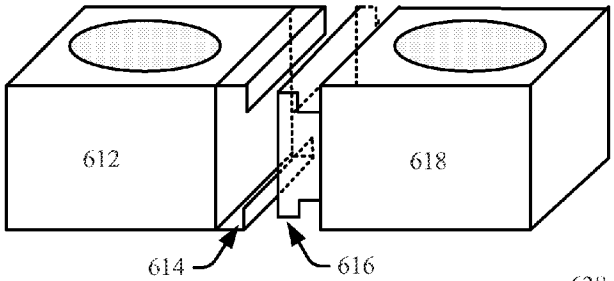
Figure 6C:
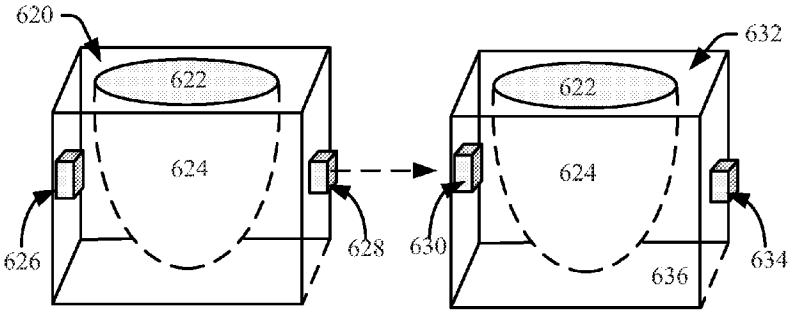

Referring now to FIGS. 6A-6C, shown are three embodiments of units and the manner in which two units can connect together. Although only individual units are shown in FIGS. 6A-6C, the connecting mechanisms shown can be employed by a row wherein seven units are permanently unified. Further, as discussed supra, a variety of other suitable connecting mechanisms can be employed. Looking at FIG. 6A, shown are units 604 and 610. The units are shown with their lids 602 open. At 606 is a peg on one side of unit 604. At 608 is a slot on unit 610 in which the peg 606 of unit 604 fits into. The peg 604 fits snuggly into the slot 606 so that the two units do not become easily separated during movement. Although depicted with pegs shaped as a rectangular prism, an APO can employ pegs and reciprocal slot with a variety of suitable shapes. For example, the peg and slot can resemble a ball and socket. The size of the peg and slot can further vary considerably. For example although the peg 606 shown only constitutes a small area of the side of the unit 604, the peg can constitute up to about 90% of the unit. At FIG. 6B, shown are units 612 and 618 that connect together via a rail and track mechanism. The units 612 and 618 are depicted without lids. Unit 612 includes a track 614 on one end in which the rail 616 of unit 618 can slide into. The size of the rail and track can vary. In one embodiment, the rail and track do not add to the thickness of the units. Thus unlike the rail and track depicted in FIG. 6B, the rails and track are contained within the thickness of the unit.

Looking at FIG. 6C, depicted are two units 620 and 632 with the same connecting mechanism as the units in FIG. 6A. FIG. 6C depicts standard units with connecting mechanisms on two sides. Although not shown, the same connecting mechanism can be employed on all four sides and can be employed by a row starter unit and column starter unit. At 626 and 630 are slots, and at 628 and 634 are pegs. As with the units in FIG. 6A, a peg is designed to snap into a slot and connect two units together. Further, FIG. 6C depicts the internal structure of a unit. Looking at unit 632, in one embodiment, a unit comprises a receptacle 624 with an opening 622. The receptacle can employ a variety of shapes and sizes. Accordingly, a receptacle can hold several pills of varying shapes and sizes. As shown in FIGS. 6A-6E, the receptacle has a semi-ellipsoid shape. A semi-ellipsoid shape compliments the shape of a finger and provides an easy structure to retrieve pills contained therein. However, a receptacle is not limited to a particular shape or size. For example, the receptacle can be rectangular. The receptacle 624 is surrounded by the base walls of the unit 636. The space between the receptacle and the base walls of the unit can be hollow or solid. Further, attachment means, such as the slot for a peg, or a rail or track, can be provided within the space between the receptacle 624 and the base walls of the unit. Alternatively, although not show, a unit can merely comprise of four base walls, thus providing more room for pills.

As depicted in FIGS. 1-6, a unit is generally square or rectangular shaped. A standard unit can be square or rectangular shaped and employ a variety of dimensions such that a unit has a volume in the range of about 15 $mm^3$ to 270 $mm^3$. In one embodiment, a standard unit is 15 mm×15 mm×15 mm. In another embodiment, a standard unit has dimensions 10 mm×10 mm×5 mm. A row starter unit and a column starter unit can have similar dimensions to that of a standard unit. However, a particular row starter unit and/or column starter unit can have slightly larger dimensions than a standard unit in order to allow for an extended structure upon which a time, day or other type of label, is displayed. Looking at FIG. 6D, presented is a row starter unit with an extended structure 638. Although, depicted as a row starter unit, the unit in FIG. 6D can also be a column starter unit. The extended structure can be a hollow or solid piece of material. In this embodiment, the extended material 638 simply serves as a platform upon which a label is displayed. The label can be a sticker or a magnet designed to fit on top of the extended material. Alternatively, the units can be manufactured with the appropriate label on the extended material. In another embodiment, the extended material can employ a whiteboard type of material upon which a user can write and erase wording directly onto the material. It should be appreciated that a variety of mechanisms can be employed in order to label a row starter unit and a column starter unit in accordance with an APO. FIG. 6E presents the configuration of a unit which is both a row starter unit and a column starter unit. Such a unit is positioned at the upper left corner of any APO and is generally the first unit of an APO, for example the unit for Sunday and the first time of day. The unit in FIG. 6E has extended material on two sides, including extended material 638 and 640.

Figure 6D:
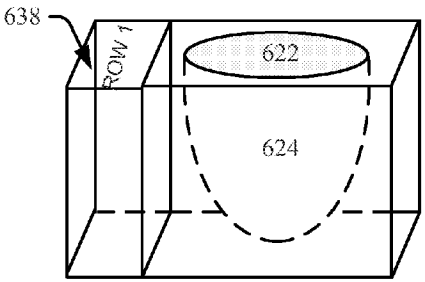
Figure 6E:
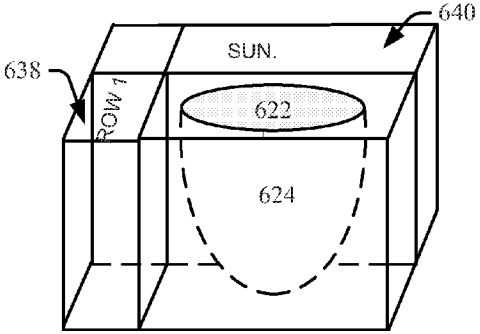

Referring to FIGS. 6C and 6D, a unit can be made of a variety of materials. In one embodiment, a unit is made of sturdy plastic. In another embodiment, a unit is made of a metal, such as stainless steel. Accordingly, an APO such as that pictured in FIG. 1 can be made of plastic or metal. If a unit includes a receptacle 624 or 634, the receptacle can be the same material as the unit or employ a different material. For example, the unit can be stainless steel while the receptacle is plastic. Further, in an embodiment wherein units employ magnets on the side in order to attach to one another, the space between the unit base walls 636 and the receptacle 624, can consist of an insulating material. Similarly, the extended material can employ either plastic or metal or a combination of thereof. In another embodiment, the extended material can consist of any suitable material capable of serving as a platform for a label. Looking at FIG. 5, lids 502 and 504 can also be made of any suitable material such as plastic or metal.

Figure 7:
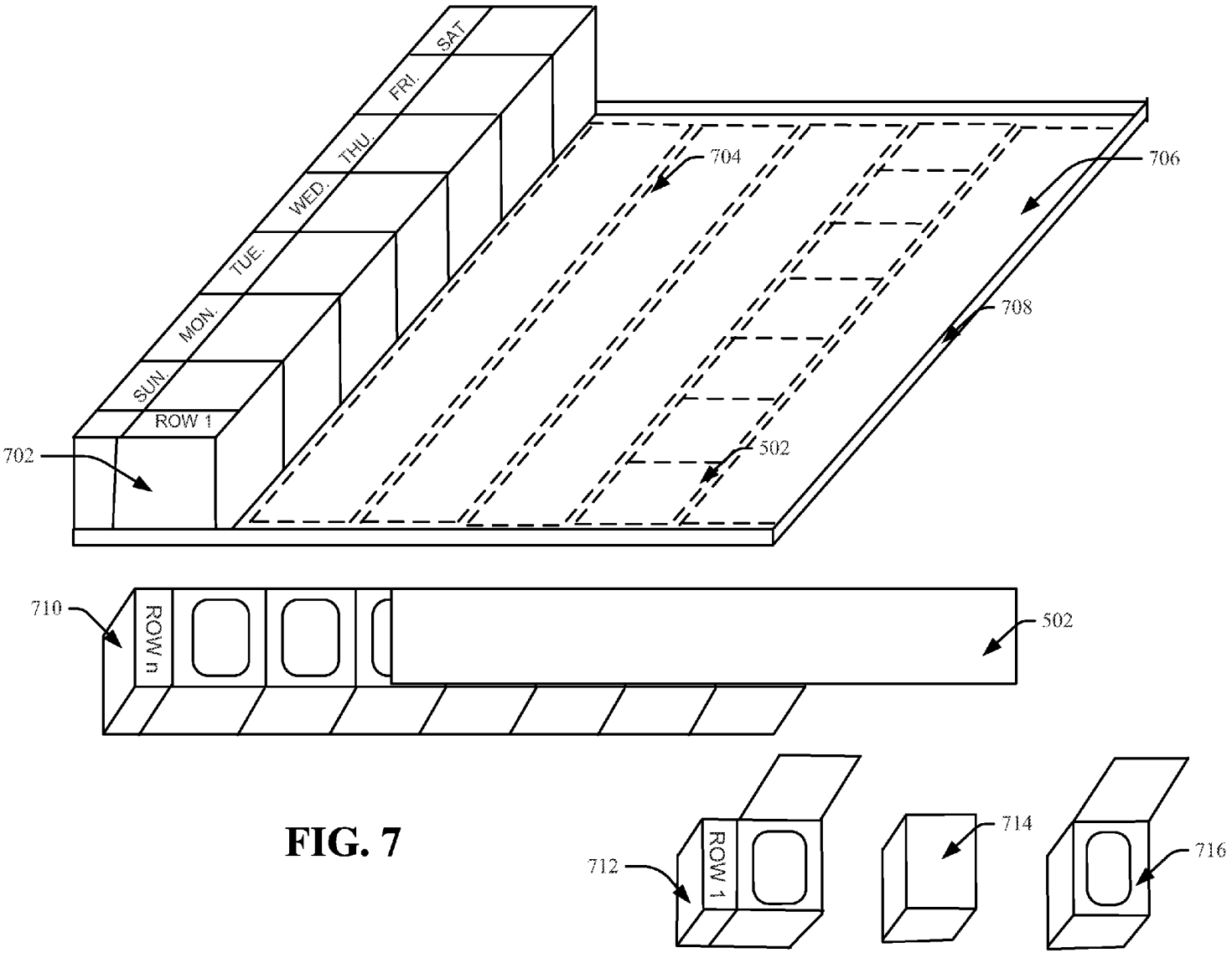
FIG. 7 illustrates an embodiment of and adaptable pill organizer with a base sheet.

Referring now to FIG. 7, presented is another embodiment of an APO wherein rows 710 and/or units 712-716 attach to a base sheet 706. In this embodiment, an APO consists of a primary row 702 with an attached base sheet 706 that extends outward from the primary row. The base sheet provides a platform upon which a unit and/or a row can attach and detach. The base sheet can vary in thickness and rigidity. For example, the base sheet can be thin and flexile or rigid and thick. The base sheet can comprise of metal or plastic. The base sheet 706 can employ a variety of mechanisms that allow a unit and/or row to attach to it. In one embodiment, a unit or row comprises a raised ridge along the outer perimeter of its base (not shown), which snaps into a complementary trench etched into the base 704. As depicted in FIG. 7, the trench is represented by the dashed line and can accommodate the attachment of an entire standard row 710, a row starter unit 712, a filler unit 714, and/or a standard unit. In another embodiment, the units/rows are magnetic and attach to a metal base, or the base 706 is magnetic and the units/rows are metal. In another embodiment, the units/rows attach to the base through Velcro components employed on either the base or the units/row. The base can further employ a raised area 708 along the perimeter that serves to enclose the base sheet. The raised area 708 acts a rail or sidewall and prevents units/rows from shifting off the base sheet. The raised area can extend upward from the base with a height in the range of about 0.1 mm to a height equal to that of a unit.

Figure 10:
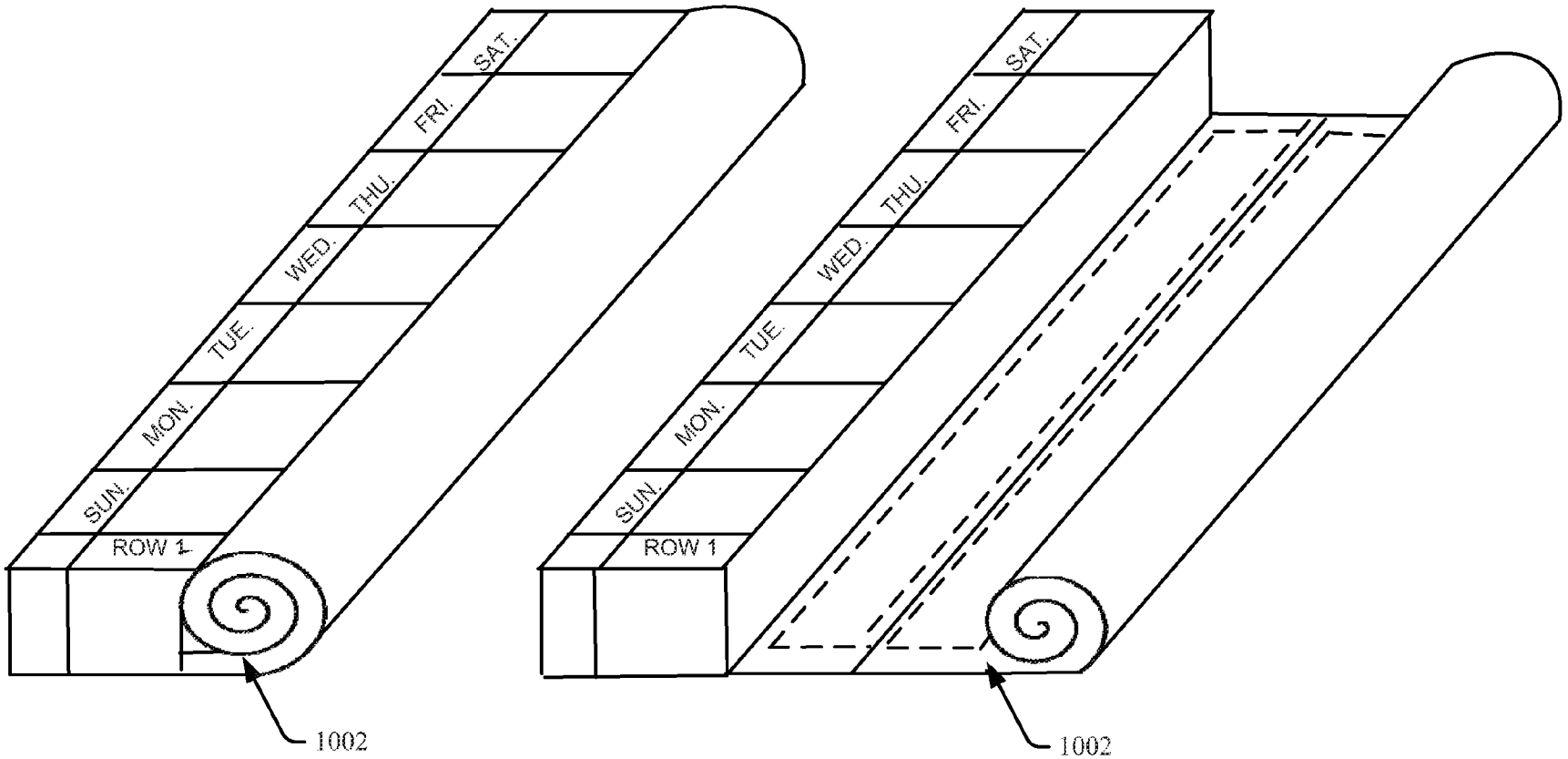
FIG. 10 illustrates an embodiment of and adaptable pill organizer with a base sheet that rolls and unrolls.

FIGS. 8A-8C present an embodiment of an APO with a base sheet 706 that folds upon itself to create an APO with a compact structure. Alternatively, as depicted in FIG. 10, a base sheet may roll up upon itself. The base sheet 706 further unfolds in segments where each segment corresponds to an area upon which a unit and/or row is attached. FIG. 8A presents and embodiment of an APO comprising a primary row 702 and a base sheet with five segments. In FIG. 8A, the base sheet 706 is entirely folded upon itself. The base sheet further comprises a means to secure the folded base sheet in a manner such that it does not unfold unless a user manually pulls the segments apart. For example, the base sheet can be magnetic. In another embodiment, the folded portion of the base sheet can attach to the sidewall of the row or the unit immediately preceding the folded base sheet. FIG. 8B depicts an embodiment of an APO with a primary row 702 and a base sheet 706 which folds and unfolds. In this embodiment, the base sheet is unfolded to expose two segments upon which a row can attach.

FIG. 8C demonstrates a mechanism by which a folded base sheet 802 unfolds in segments. In FIG. 8C, the base sheet 802 comprises five segments. However, it should be appreciated that a base sheet can comprise any number of segments from one to 1000. A segment can be a rigid material or a flexible material. For example, the base sheet can be a thin flexible sheet of plastic with perforated areas separating each segment and allowing the base sheet to fold upon itself along the perforated areas. The base sheet can also comprise rigid metal segments attached to one another by hinge. At 802, the base sheet is entirely folded upon itself. At 804, the base sheet is in the process of unfolding. As demonstrated by the unfolding base sheet 804, every other joint between a segment bends in the opposite direction such that each segment folds upon itself.

Figure 9:
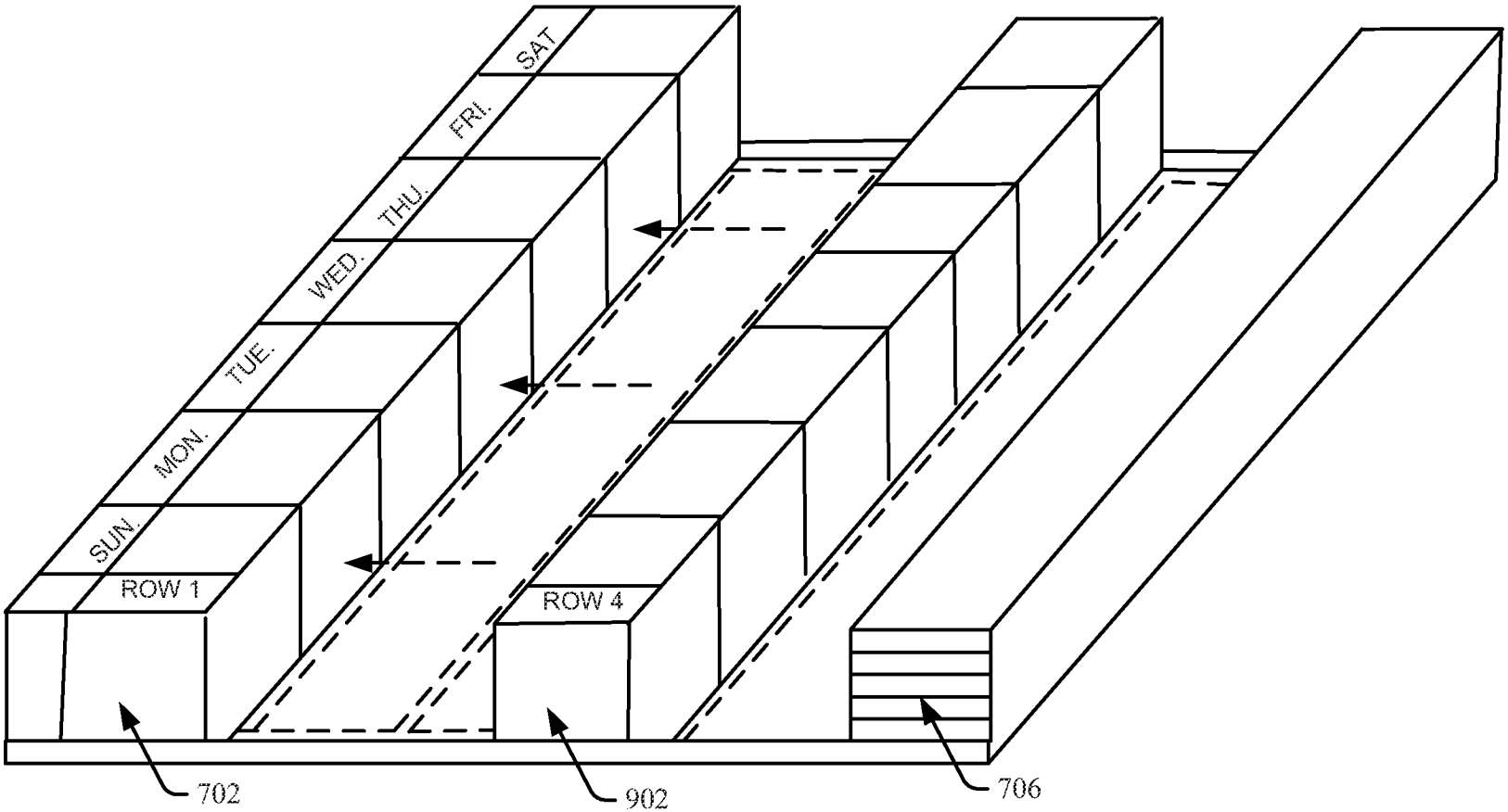
FIG. 9 illustrates an embodiment of and adaptable pill organizer with a base sheet and the manner in which the base sheet folds and unfolds in order to provide space to attach a row and/or a unit.

FIG. 9 presents an APO with a folding base sheet. In this embodiment, the base sheet 706 comprises ten segments. As shown, four of the segments are unfolded and six of the segments remain folded. This embodiment demonstrates how a standard row is attached to a segment of the base sheet. It should be appreciated that a user can attach rows or units to any unfolded segment of the base sheet 706, however, generally a user will add rows and segments in consecutive order following the primary row 706. Further, this embodiment demonstrates how a user can easily shift rows along the base sheet. For example, in this embodiment, rows 2, 3, and 5 have been removed. Accordingly row 4 remains and can be shifted to the first segment in order to consolidate space and become the new row 2. As noted supra, a variety of mechanisms can be employed in accordance with the subject invention that allow for the changing of the labeling of rows.

FIG. 10 presents an embodiment of an APO wherein the base sheet 1002 rolls upon itself. The base sheet 1002 can comprise any of the features and elements of base sheet 706 discussed supra with reference to FIGS. 7-9. In addition, the base sheet 1002 can roll and unroll in order to provide enough space on the base sheet to attach additional rows and/or units. In FIG. 10A, the base sheet is entirely rolled up. In FIG. 10B, the base sheet 1002 is unrolled enough to create space for two additional rows. The rolled base sheet further comprises a mechanism to prevent the rolled sheet from unrolling any further then the desired distance required to create space for additional units or rows. In one embodiment, the base sheet 1002 comprises segments separated by a joint. In another embodiment, the base sheet is a continuous material that is not disjointed. For example, the base sheet can be a thin flexible nylon fabric upon which segments or units attach by way of a Velcro.

Electronic APO

Figure 11:
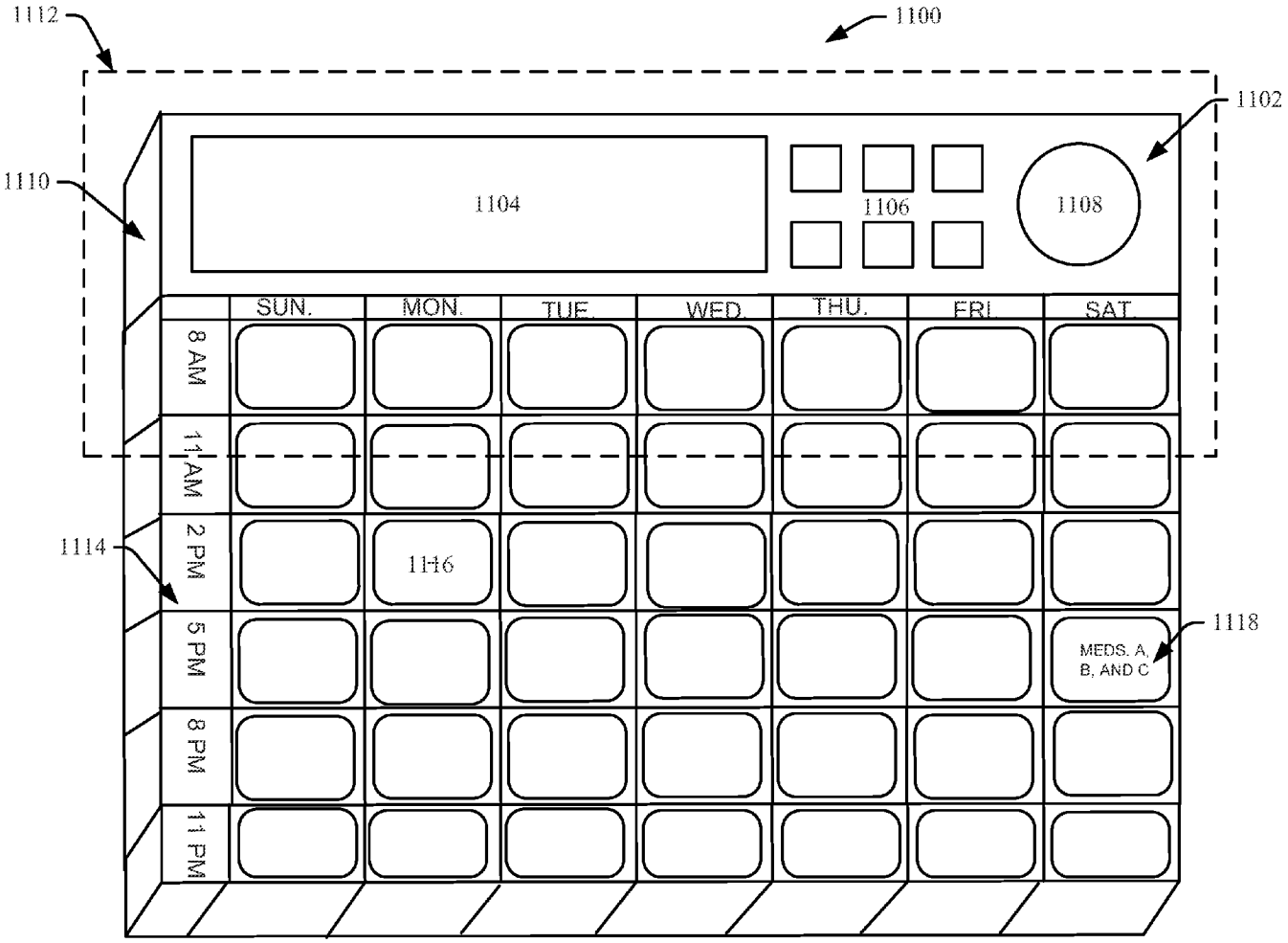
FIG. 11 illustrates an embodiment of an electronic pill organizer with electronic capabilities and an interface component.

Referring now to FIG. 11, presented is an embodiment of an APO 1100 with various electronic capabilities. In addition to the features and aspects described supra with respect to a non-electronic APO, including the structure of the units, and the features of connectivity between the units and/or rows, an APO can further employ various electronic aspects. These electronic features will now be described with respect to FIGS. 11-19. It should be appreciated that many of the features described above with respect to a non-electronic APO can be integrated into the electronic version of an APO.

As used herein, the terms "component", "module", "system", and the like are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

Furthermore, the one or more embodiments may be implemented as a method, apparatus, or article of manufacture using standard programming and/or engineering techniques to produce software, firmware, hardware, or any combination thereof to control a computer to implement the disclosed embodiments. The term "article of manufacture" (or alternatively, "computer program product") as used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications may be made to this configuration without departing from the scope of the disclosed embodiments.

Figure 12:
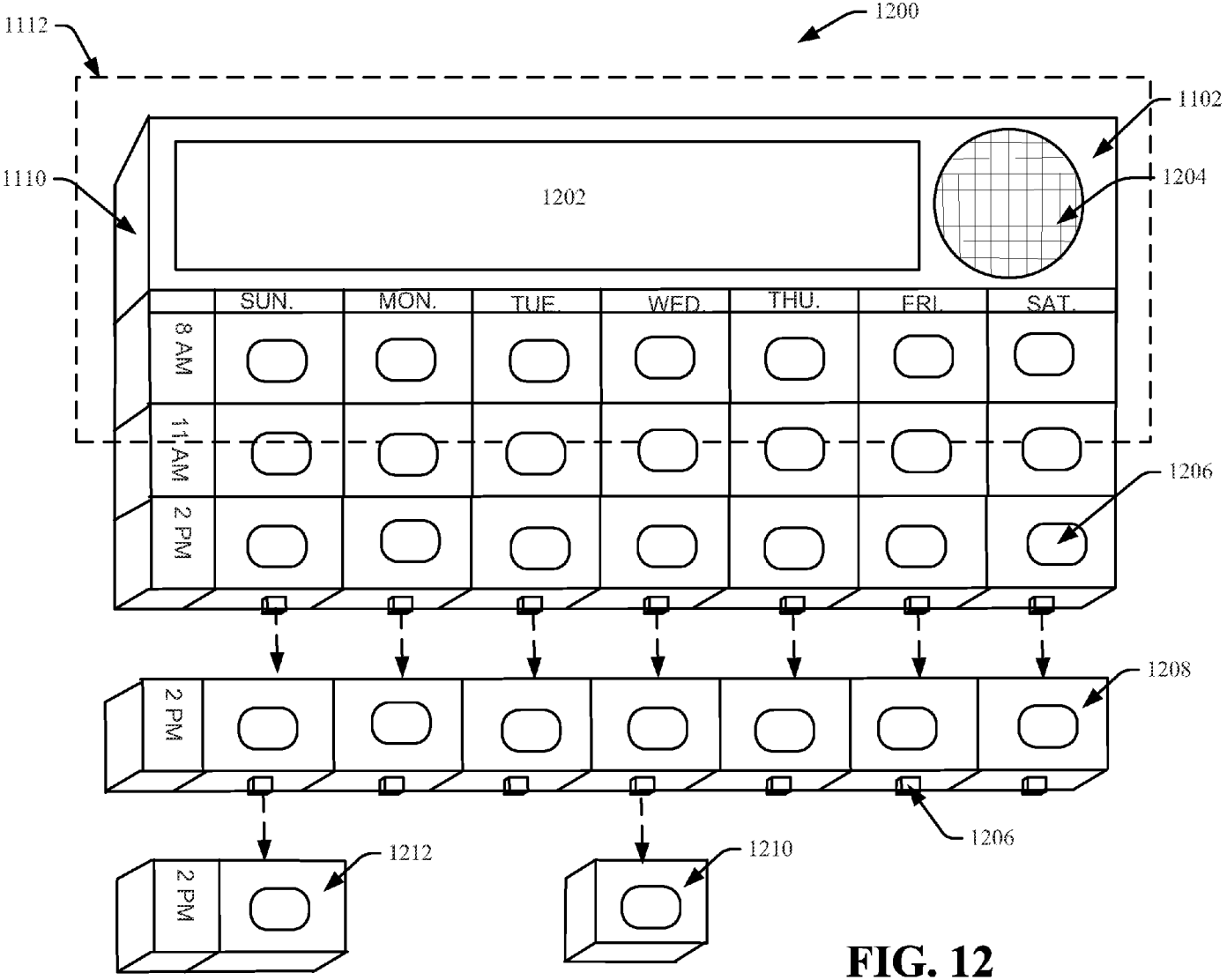
FIG. 12 illustrates another embodiment of an electronic pill organizer with electronic capabilities and an interface component.

Referring back to the drawings, FIGS. 11 and 12 present two embodiments of an APO with an electronic interface component 1102 included with a primary row. A variety of interface arrangements and elements can be employed in accordance with the subject invention. In one embodiment of an electronic APO 1100 as depicted in FIG. 11, the interface component 1102 includes an LCD screen and various means for interfacing with the APO including buttons 1106, and a dial 1108. In another embodiment as depicted in FIG. 12, the interface component 1102 includes be a single large touch screen LCD 1202 for interacting with the APO. Further, the interface component can include a speaker 1204. It should be appreciated that the embodiments of the electronic APO's depicted in FIGS. 11 and 12 merely provide examples of possible user interfaces for an APO and are not intended to limit an APO to a specific configuration. The area below the interface component 1110 houses the appropriate circuitry, components, and power source for the APO, all of which are properly encased within a suitable material such as metal or plastic or a combination thereof. A variety of power sources are appropriate to power the APO 1100 including but not limited to a battery, and/or an AC/DC circuit. Further, the electronic APO includes a computer capable of supporting the various functions of the electronic APO as discussed supra.

The interface component 1102 and the electrical aspects housed below 1110 along with the primary row, all constitute the base 1112 of an electronic APO. An electronic APO can consist of only a base. In another embodiment and as depicted in FIGS. 11 and 12, an electronic APO can include several standard rows in addition to the primary row. The APO can consist of several standard rows in a permanently fixed state or the rows and or individual units can be detachable as described with reference to FIGS. 2 and 3. FIG. 12 depicts an APO with detachable rows 1208 and units 1210 and 1212. In one embodiment, all standard rows aside from the primary row (which is included with the base 1112) are detachable. In another embodiment, all units aside from those included in the base 1112 are detachable.

When the rows 1208 and/or units are detachable, each row and/or unit consists of an attachment means 1206, such as the peg and slot mechanism described infra. Included within the attachment means 1206 for rows and units associated with an electronic APO is the capacity to electronically connect one row or unit to that of another in order to establish an integrated circuit that allows respective units to be communicatively or operationally coupled. It should be appreciated that each row/and or unit is provided with the appropriate electronic circuitry to facilitate at least one of: wired communications, wireless communications, sensing, lid control, lighting, or generating and sending notifications. In one embodiment, the area below the extended structure of a row starter unit 1212 houses various electrical components. In another embodiment, the area between the receptacle and the sidewalls of a unit houses electrical components.

In addition to the interface component 1102 of the base 1112, each of the units can employ an LCD screen 1116. In the embodiment depicted by FIG. 11, the LCD screen is large enough to display text. For example, at 1118 each LCD screen of a specific unit can display features relating to the medication contained therein. In another embodiment as depicted by APO 1200, each unit can employ an LCD light 1206. In one embodiment, the LCDs are integrated within the lid (not shown) of each unit. In one embodiment, the LCD's are touch screen. Alternatively, the APO 1000 can employ units without LCDs and the lids described supra with respect to FIGS. 5 and 6.

Further, although not shown each unit or row can include any suitable lid that opens and closes easily yet provides a secured unit when closed such that the lids do not pop open when the APO is moved and transported. In one embodiment, the lids provided can be similar to the lids described with reference to FIG. 5. In another embodiment, the electronic APO can employ an electronic locking mechanism for the lids. In this embodiment, the lids can open and shut in response to a command entered on the user interface, or in response to direct activation by the user. For example, each unit can employ a sensor which, upon touching, the cause the lit to open automatically. The lid can further shut manually or in response to a second activation by the sensor. In another embodiment, the lids can remain permanently locked and only unlock upon the occurrence of an event or command. For example, in one embodiment, the APO is programmed to lock all units at all times. However, when the medication in a specific unit is required to be taken at a designated time, upon the reaching of that time, the APO unlocks the unit. Accordingly, a user of the APO will not be able to access medication prior to the appropriate time for taking the medication.

An APO can be programmed to respond to changes in the device status, device usage, or the occurrence of defined events or signals. In one embodiment, the electronic APO employs a timer and an internal clock. In this embodiment, the electronic APO signals a response within the APO itself or a third party device, as described infra, according to designated points in time as stored in memory. For example, the APO can store the medication schedule for the individual using the device. Upon the reaching of a preset time period, the APO can generate at least one of the following responses: the lighting or change in lighting color of a unit, the sounding of an alarm, the display of a message on the primary display screen, the opening or closing of a unit lid, the unlocking or locking of a unit, or the transmittal of a message to a third party device. In another embodiment, the APO can respond in the manners described above upon the receipt of a message from a third party device or user input commands directly into the electronic device.

An electronic APO can further respond to physical usage of the APO. In one embodiment, the APO responds to sensed information pertaining to each unit. Accordingly, each unit and/or row can include a sensor component. The sensor component can provide information pertaining to the status and contents of a unit. For example, the sensor component can indicate when a unit is opened or closed and/or when the unit is empty or full. Utilizing data stored in memory relating to the appropriate status for a unit at a given point in time, the APO can signal a specific response such as those described above. In another embodiment, the APO senses when a unit is touched and displays information pertaining to that unit upon the display component 1104 of the interface component 1102.

In another embodiment, the APO can sense the quantity and quality of medication contained within a unit. For example, the sensors can detect the exact weight of the pills within a unit. The APO can compare the information with information stored in memory or accessible through a secondary network. In turn, the APO can determine whether the correct medication is contained within a unit and signal the appropriate response. In another embodiment, the sensors for each unit can analyze the pills via a chemical analysis. For instance, the sensors can facilitate various analytical chemistry methods such as spectroscopy, mass spectrometry, colorimetry, chromatography, and crystallography. In another embodiment, wherein the pill contained within an unit have watermarkings or RFID tags, the sensors can facilitate watermarking detection, or radio frequency identification (RFID) tag detection. Accordingly, the APO can detect and analyze when the correct medication is contained within a unit. In one embodiment, the APO can detect when medication is generic and/or counterfeit.

In one embodiment, a response to unit status changes includes modifications in the lighting array of the unit. In this embodiment, each unit of the APO is lit with a different color light in order signal the status of the unit. For example, when it is time to take a specific medication contained within a unit, the unit can be lit with a green light. If the medication is not taken on time as determined by sensors included within the units, the light can turn yellow in order to signal tardiness in taking the medication. A light can remain yellow for a designated period of time, for example, one hour. Following the cautionary or yellow period, the light can turn red in order to signal the missed taking of the medication. It should be appreciated that a variety of color designations and lighting responses can be employed in accordance with the subject invention and an APO is not limited to the lighting assignment and responses described above.

The sensor component can further detect changes in the configuration of an APO consisting of detachable rows and/or units. When rows and/or units are added to one another, the APO detects the addition and updates its program setting accordingly. For example, looking at FIG. 12, the electronic APO 1200 consists of both detachable rows and units. Although the electronic APO is pictured with three attached rows, in this embodiment each of the rows aside from the primary row are separable. In this embodiment, prior to attachment of the second and third rows, the APO consisted of only a base 1112. Upon the attachment of the second row, the electronic APO senses the addition and automatically reconfigures itself to accommodate the added row. Similarly, the electronic APO can sense when a single unit is added, as opposed to an entire row, and automatically accommodates itself for the new unit. The APO recognizes additions through sensors contained within each unit or row, including the primary row. In another embodiment, sensors are contained within the attachment means, 1206.

Referring back to FIGS. 11 and 12 generally, the interface component 1102 allows a user and/or a third party to interact with the electronic APO. The APO has the capacity to store a variety of information which can be retrieved and displayed on the display component 1104, audibly communicated, and/or sent to a third party device. For example, the APO can store information pertaining to a user's medication, the user's medication schedule, and/or a user's medical history. The interface component further allows a user to set alarms and responses for the APO, such as those described above, and generate and send messages to third parties. In addition to the ability to provide an alarm, the electronic APO can further employ a component for producing additional sounds, such as music or verbal descriptions. For example, in the alternative or in addition to displaying information on the LCD screen 1104, the APO can produce an audible description of the information displayed.

The interface provides an interactive forum for the user of an electronic APO. Thus in addition to providing/presenting information about usage of the APO, the user interface can assist in the filling of an APO. For example, when each unit contains an LCD screen, each unit can be labeled with the assigned mediation via text or pictorial depictions on the LCD screen. Further, in another embodiment, in conjunction with the sensors contained within each unit, the electronic APO can assist in the filling of the APO. For example, the medication information for a unit either can appear on the LCD screen of the unit or be audibly relayed to the user, in response to touching of the unit. As discussed above, the electronic APO can serve to ensure the proper and accurate filling of units.

Figure 13:
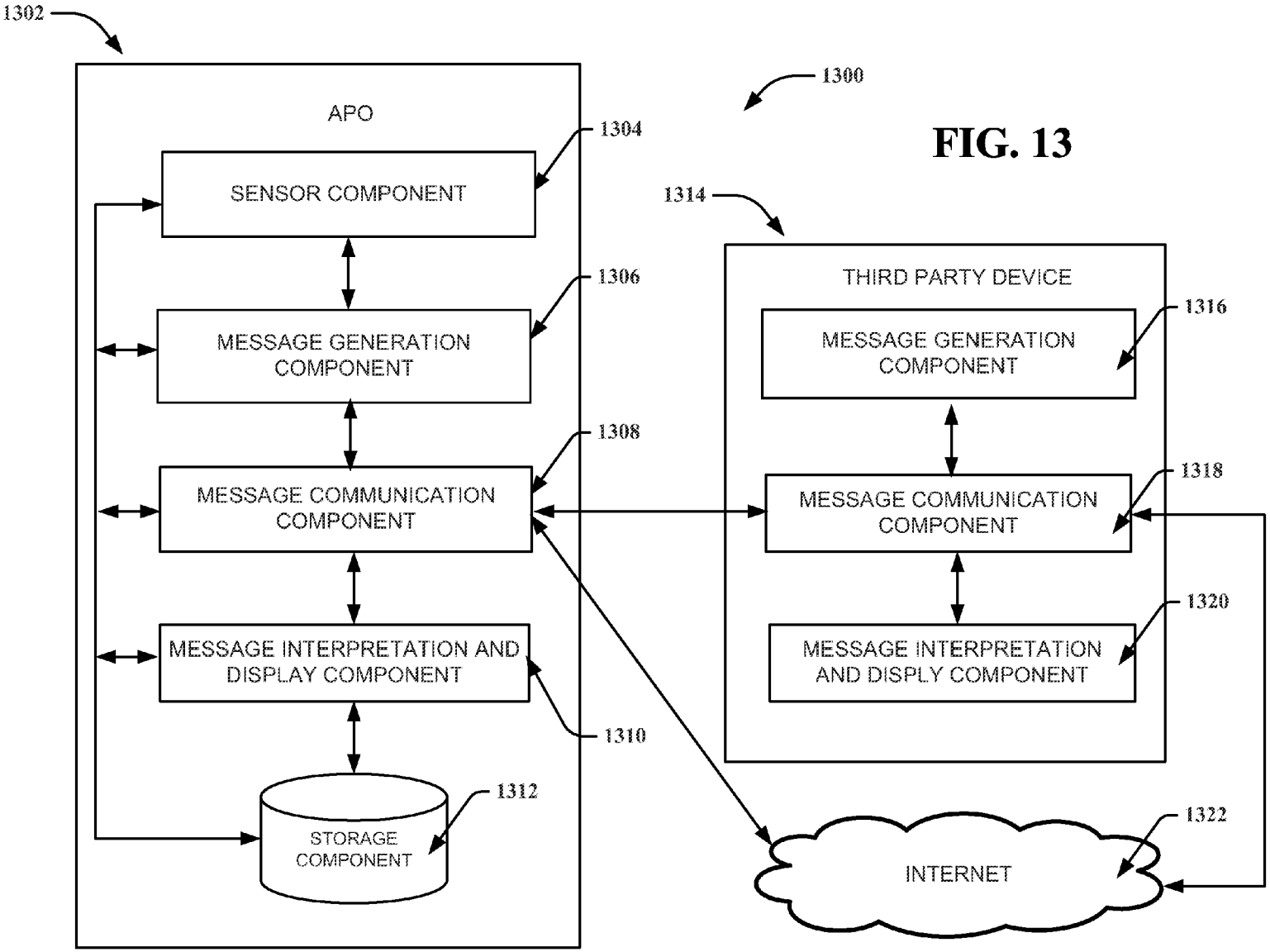
FIG. 13 illustrates a high level block diagram of a system for managing and regulating a medication regime.

Referring now to FIG. 13, presented is a high level illustration of an electronic APO interaction system 1300. The system can be employed on an electronic APO alone, or in conjunction with a third party device 1314. The system allows an electronic APO to receive information either via input by the user through the interface component 1304, through detection by sensors through the sensor component 1304, or from a third party device, and produce a response in the APO. The system further generates information pertaining to usage of the APO and causes the information to be stored in memory of the APO and/or sent to a third party device in real time. The information is sent to the third party device in an appropriate form in order to illicit a response in the third party device, such as display of the information. The system further allows a user of a third party device to request information from the APO, or send information to the APO. Accordingly, the system 1300 allows a third party to monitor and direct the usage and various feature of an electronic APO from a remote location.

As depicted in FIG. 13, the system 1300 includes an electronic APO and a third party device 1314. The electronic APO can be a portable wireless device or a wired stationary device and can include all of the aspects and features of an electronic APO and non-electronic APO discussed supra. The third party device can include a variety of wire line and wireless devices such as POTs telephones, interactive TV's, PC's, cellular phones, PDAs, laptop computers, etc. It should be appreciated that additional computing devices for use in a compliance with the claimed invention may exist or arise, all of which should be considered within the general scope of the system 1300. The APO and the third party device have the ability to wirelessly communicate with one another through the message communication component employed in each device. The APO and the third party device can further communicate with an external network such as the internet 1322.

The system 1300 employs several components that are employed in conjunction with an APO, including a sensor component 1304, a message generation component 1306, a message communication component 1308, a message interpretation and display component 1310, and a storage component 1312. The sensor component 1304 senses APO usage and changes in the status of the APO. For example, the sensor component senses when a unit is opened or closed, or empty or full.

In response to the sensed data, the sensor component sends the information to the message generation component for further processing. The message generation component receives the sensed information and generates a message in a form that can be interpreted by either the APO or a third party device. The message can include multimedia, text, or an encryption to illicit a response in either the APO or a third party device. The message generation component can communicate with the storage component 1312 or an outside network such as the internet 1322 via the message communication component 1308 in order to determine the appropriate response to a generated message. A response in the APO itself can include but is not limited to: the display of information, a modification to the lighting of a unit on the APO, the sounding of an alarm, or the initiation of a message transfer to a third party device. If a message is sent to a third party device, a response can include but is not limited to: the ringing of a phone, the display of information in the form of a text or multimedia message, the sounding of an alarm, or the turning on or off, of another device.

The message generation component further communicates with the storage component 1312 or an outside network 1322 to compare the sensed information with information stored in the storage component, or available via the internet, in order to generate an appropriate message. For example, the storage component can store a user's medication schedule, or an outside database can store medication identification information. When the sensed data indicates that a unit is empty or identifies a type of medication via a RFID tag, the message generation component determines if the unit is suppose to be empty according to the medication schedule, or if the medication is correctly identified. If empty is the appropriate status for the unit at the given point in time, the message component can generate a message such as "Medication Taken, 12 pm." The message can then be sent to the message sent to a third party device. Similarly, if the medication is identified as the correct medication in a unit, a message can be sent to a third party device. Alternatively, the message generation component can be programmed to only send specific messages to a third party device, such as only when the status of a unit does not correlate correctly with a medication schedule.

In another embodiment, the message generation component works in response to information directly input to the APO by the user of the device through the interface component 1302. For example, a user can input information such as a new medication schedule or medical history information and request the device send the information to a third party device. The message generation component works in conjunction with the storage component 1312 to retrieve the information and package the information with the request to send a message containing the information to a third party device.

Once a message is generated, the message is channeled to the message interpretation and display component of the APO 1310, or the message communication component of the APO 1308, or to both components. The appropriate destination for the message is determined by the message generation component 1306 through utilization of information stored in the storage component. Thus in addition to the generation of a message, the message generation component encrypts a message with various directional indicators. For example, the message generation component can tag a message such that it is sent to the appropriate third party device and/or displayed on the APO itself. A user can program specific responses for the APO and/or the APO can be preprogrammed to respond to usage in a specific manner. If a message includes information which is to be interpreted by the APO itself such that a response is produced in the APO, the message is sent to the message interpretation and display component 1310.

Upon receipt of a message, the message interpretation and display component 1310 interprets the message and generates the appropriate response in the APO. It the message is to be communicated to a third party device, the message is sent to the message communication component. In the alternative or in the addition to the message generation component 1310, utilizing information stored in the storage component 1312, the message communication component 1308 determines the appropriate third party device to send the message to and configures the message in a format that is readable by the third party device. Finally, the message communication component sends the message to the third party device. The message communication component 1308 further provides communication between the system and an outside network such as the internet 1322. The message communication component can further comprise a security component, (not shown) which ensures the safe and accurate transfer of information between devices. Any available communication security software is can be employed in accordance with the subject invention.

Looking back to FIG. 13, the system 1300 further includes a third party device that can receive messages from an electronic APO as well as generate and send messages to an APO. Each third party device can be pre-authenticated and secured with one or more APO's. Alternatively, the APO and the third party device and employ a variety of available security mechanisms in order to ensure the appropriate information is accurately and safely sent to between devices. A third party device receives a message through a message receipt and transfer component 1318. Upon receipt, the message is transferred to a message interpretation and display component on the third party device 1320. The message interpretation and display component then generates the appropriate response within the device. It should be appreciated that the variety of third party devices listed above include the requisite hardware and can be programmed in a matter such that the devices can be made compatible with the subject system.

The third party device can further generate and send messages to an APO. For example, a third party device can employ a message generation component 1316, which allows for a user of the device to generate a message. The user of the device could send a textual message to the APO, such a new prescription list or schedule. Alternatively or in addition to, the user could send a message that directs the APO to carry out a physical action such as the sounding of an alarm or the unlocking/locking of a unit. Upon generation of the message within the third party device 1314, the message is sent to the message communication component 1318 of the third party device. The message communication component then sends the message in the appropriate form and under secured and authorized connection to the appropriate APO. Upon receipt by an APO of a message from a third party device, the message is channeled from the message receipt and transfer component of the APO 1308 to the message interpretation and display component 1310 of the APO, or the storage database of the APO 1312, or to both components.

Figure 14:
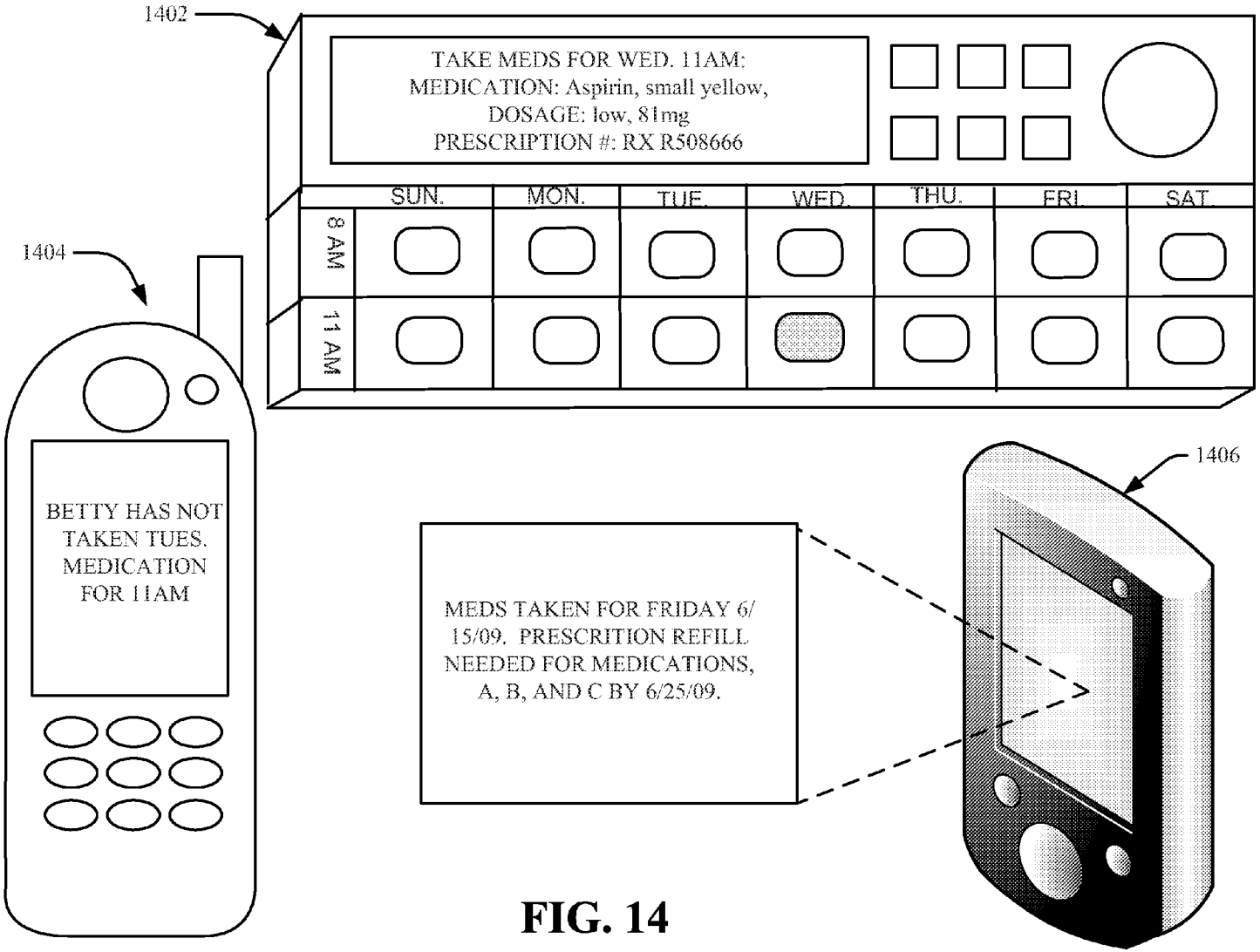
FIG. 14 illustrates various responses to usage of an electronic pill organizer within third party devices.

Referring now to FIG. 14, presented are three embodiments of message responses within devices in accordance with the subject system. At 1402, presented is an electronic APO. Each of the units of the APO 1402 employs an LCD light. As shown, the light for the unit correlating to 11 am on a Wednesday is lit up indicating it is time to take the medication contained within. Further, the display screen of the APO presents information about the particular medication contained within the designated unit. At 1404, presented is a third party device cellular phone. The phone displays a message received from an APO. The message indicates that "Betty" has not taken her medication for Tuesday at 11 am. According the system allows a third party such as a caregiver or relative to monitor another's self medication regime. Upon receipt of the message, the third party caregiver can respond accordingly. At 1406, presented is a PDA with a message received from an APO. Included in the message is additional information about the status of the APO users' medication needs. The aforementioned responses are merely a subset to the various responses the APO interaction system is capable of generating and are not intended to limit the application of the subject disclosure.

Figure 15:
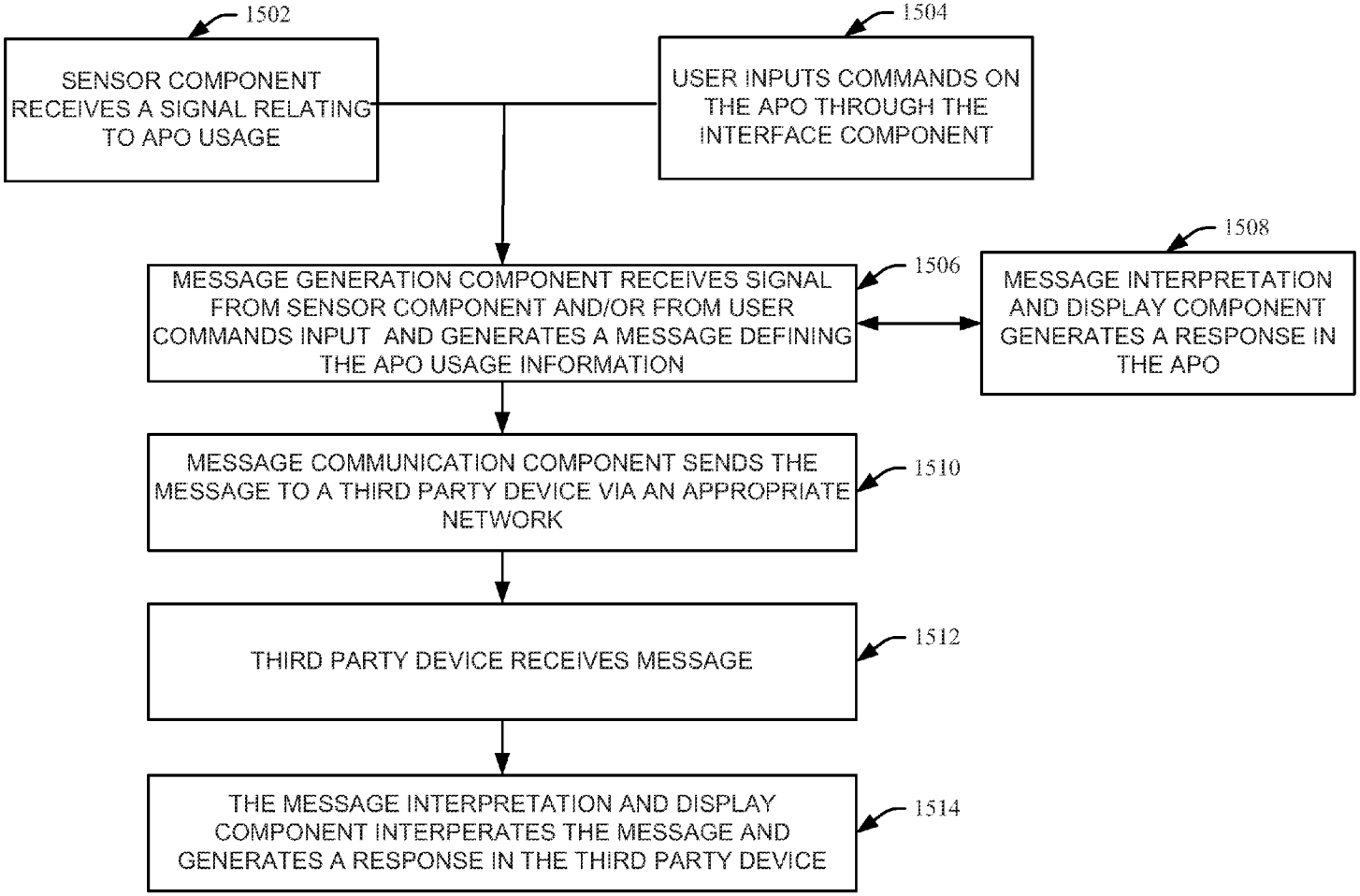
FIG. 15 illustrates a block diagram of the method by which the usage of an electronic pill organizer is managed, tracked and conveyed to a user of the electronic pill organize or a user of a third party device.

Referring now to FIG. 15, presented is a methodology by which an APO interaction system responds to APO usage. At 1502, the sensor component receives a signal relating to APO usage. For example, the sensor component can receive a signal indicating that a unit is empty or full. Alternatively or in addition to information received by the sensor component, at 1504, a user can input commands or data directly on the APO through the interface component. For example, a user can input directions for a the APO to sound an alarm at a specific time or a user can input a command to send a data sheet encompassing information stored in the storage component of the APO to a third party device. At 1506, the message generation component receives a signal from the sensor component and/or from user commands as input on the device through the interface component, and generates a message defining the APO usage information. In order to generate the message, the message generation component correlates the signals and commands it receives with information stored in the storage component.

Following generation of the message, at 1508, the message generation component can send the message to the message interpretation and display component of the APO. The message interpretation and display component interprets the message and carries out the appropriate response in the APO. For example, the message interpretation and display component can display a textual or multimedia message on the LCD screen of the APO. Another response can include the sending of the message to the storage component. Another response can include sounding an alarm or providing an alternative audio response. Still another response can include the locking/unlocking of a unit.

In addition or in the alternative to generating a response within the APO itself, upon the generation of a message by the message generation component, the message generation component can send the message to the message communication component. At 1510, the message communication component can send the message to a third party device through an appropriate network. At 1512, the third party device receives the message and at 1514, the message interpretation and display component of the third party device interprets the message and generates a response in the third party device.

Figure 16:
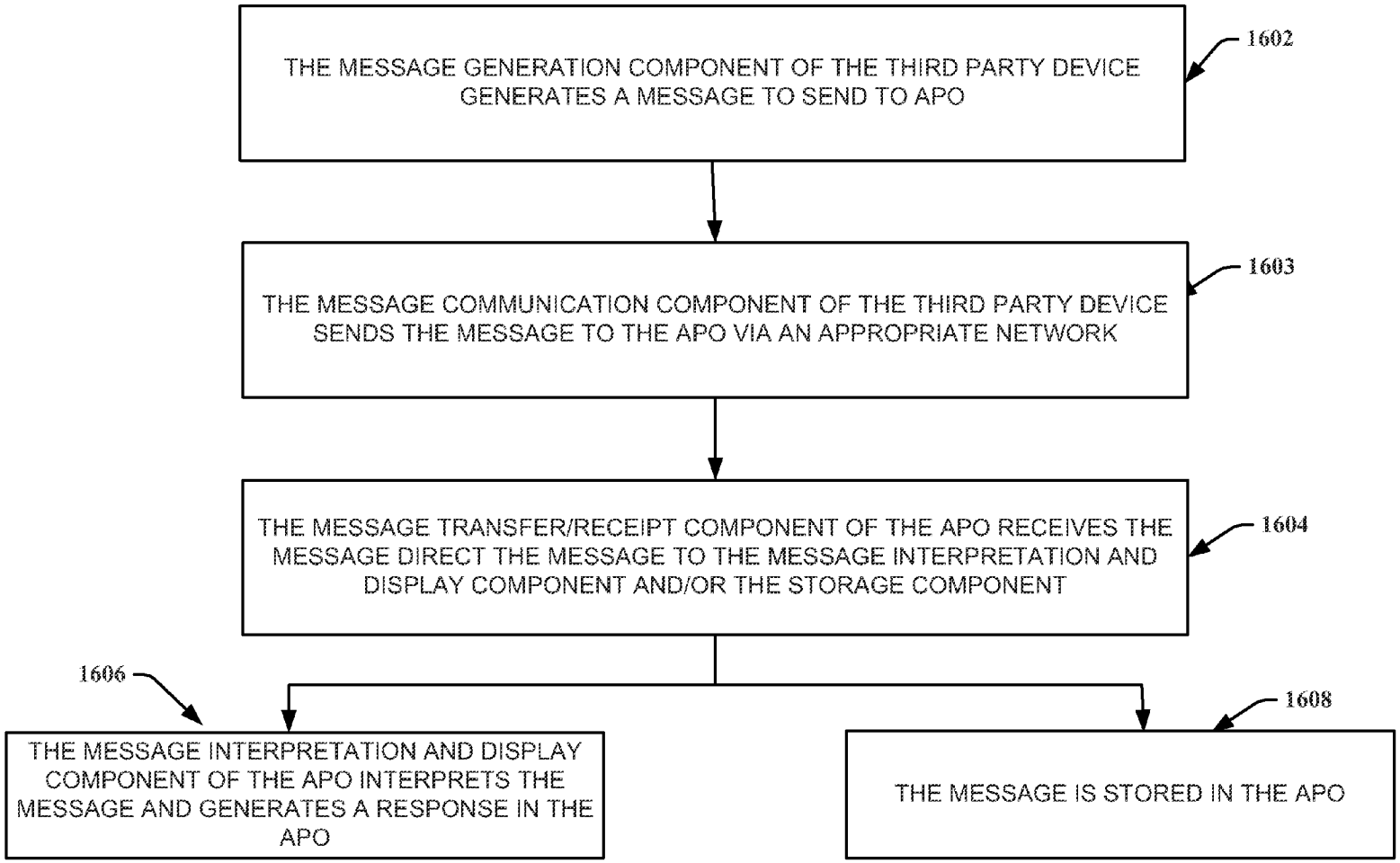
FIG. 16 illustrates a block diagram of a method by which a third party device communicates with an electronic adaptable bill organizer.

Looking now to FIG. 16, presented is a methodology by which a third party device interacts with an APO in accordance with an APO interaction system 1300. At 1602, the message generation component of the third party device generates a message to send to the APO. At 1604, the message transfer component of the third party device sends the message to the APO via an appropriate network.

Figure 17:
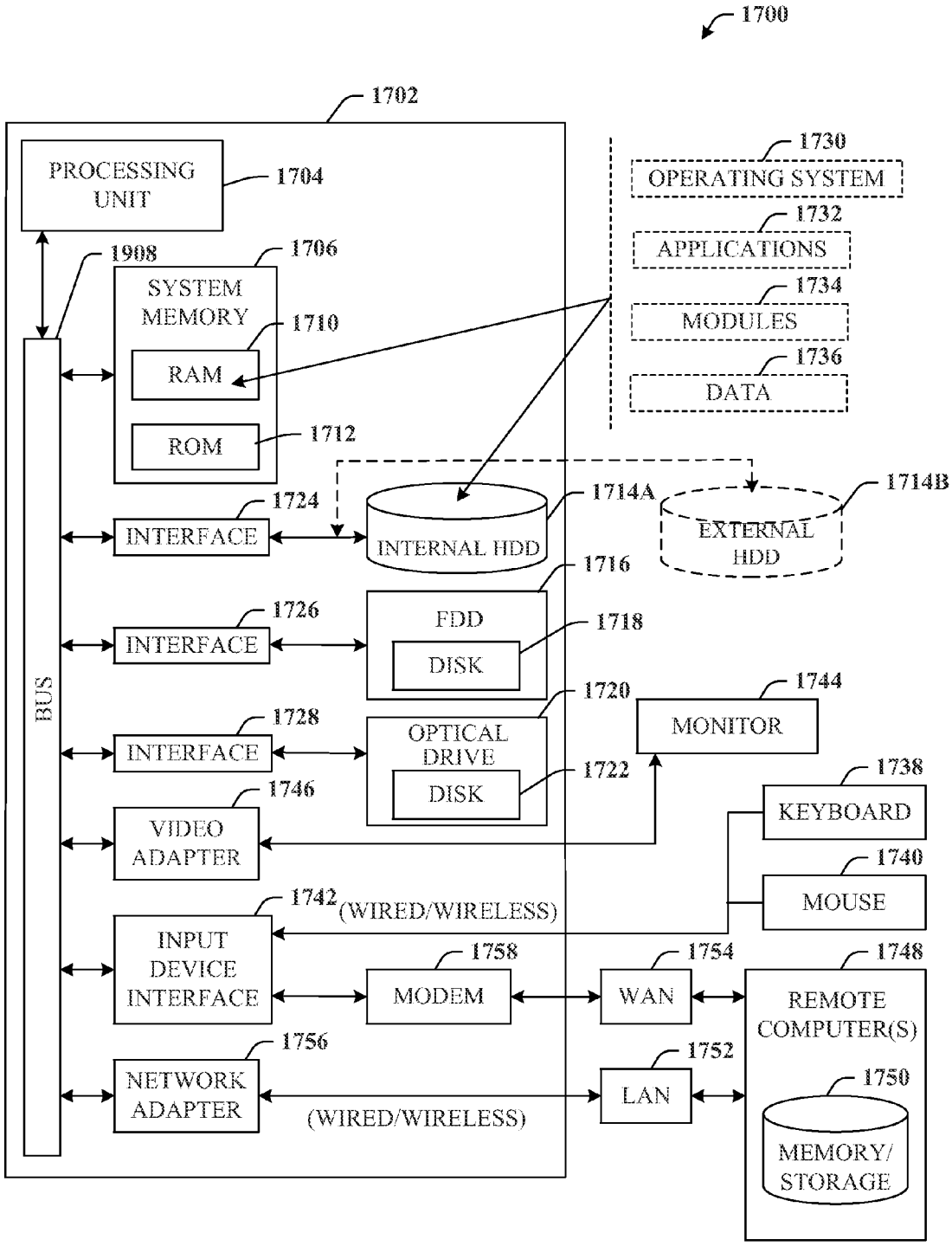
FIG. 17 there is illustrated a block diagram of an exemplary computer system operable to execute aspects of the subject disclosure.

Referring now to FIG. 17, there is illustrated a block diagram of an exemplary computer system operable to execute aspects of the subject disclosure. In order to provide additional context for various aspects of the claimed subject matter, FIG. 17 and the following discussion are intended to provide a brief, general description of a suitable computing environment 1700 in which the various aspects of the claimed subject matter can be implemented. Additionally, while the claimed subject matter described above can be suitable for application in the general context of computer-executable instructions that can run on one or more computers, the claimed subject matter also can be implemented in combination with other program modules and/or as a combination of hardware and software.

Generally, program modules include routines, programs, components, data structures, etc., that perform particular tasks or implement particular abstract data types. Moreover, the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the claimed subject matter can also be practiced in distributed computing environments where certain tasks are performed by remote processing devices that are linked through a communications network. In a distributed computing environment, program modules can be located in both local and remote memory storage devices.

A computer typically includes a variety of computer readable media. Computer readable media can be any available media that can be accessed by the computer and includes both volatile and nonvolatile media, removable and non-removable media. By way of example, and not limitation, computer-readable media can comprise computer storage media and communication media. Computer storage media can include both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the above should also be included within the scope of computer-readable media.

Continuing to reference FIG. 17, the exemplary environment 1700 for implementing various aspects of the claimed subject matter includes a computer 1702, the computer 1702 including a processing unit 1704, a system memory 1706 and a system bus 1708. The system bus 1708 couples to system components including, but not limited to, the system memory 1706 to the processing unit 1704. The processing unit 1704 can be any of various commercially available processors. Dual or quad microprocessors and other multi-processor architectures can also be employed as the processing unit 1704.

The system bus 1708 can be any of several types of bus structure that can further interconnect to a memory bus (with or without a memory controller), a peripheral bus, and a local bus using any of a variety of commercially available bus architectures. The system memory 1706 includes read-only memory (ROM) 1710 and random access memory (RAM) 1712. A basic input/output system (BIOS) is stored in a nonvolatile memory 1710 such as ROM, EPROM, EEPROM, which BIOS contains the basic routines that help to transfer information between elements within the computer 1702, such as during start-up. The RAM 1712 can also include a high-speed RAM such as static RAM for caching data.

The computer 1702 further includes an internal hard disk drive (HDD) 1714A (e.g., EIDE, SATA), which internal hard disk drive 1714A can also be configured for external use (1014B) in a suitable chassis (not shown), a magnetic floppy disk drive (FDD) 1716, (e.g., to read from or write to a removable diskette 1718) and an optical disk drive 1720, (e.g., reading a CD-ROM disk 1722 or, to read from or write to other high capacity optical media such as the DVD). The hard disk drive 1714, magnetic disk drive 1716 and optical disk drive 1720 can be connected to the system bus 1708 by a hard disk drive interface 1724, a magnetic disk drive interface 1726 and an optical drive interface 1728, respectively. The interface 1724 for external drive implementations includes at least one or both of Universal Serial Bus (USB) and IEEE1374 interface technologies. Other external drive connection technologies are within contemplation of the subject matter claimed herein.

The drives and their associated computer-readable media provide nonvolatile storage of data, data structures, computer-executable instructions, and so forth. For the computer 1702, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, can also be used in the exemplary operating environment, and further, that any such media can contain computer-executable instructions for performing the methods of the claimed subject matter.

A number of program modules can be stored in the drives and RAM 1712, including an operating system 1730, one or more application programs 1732, other program modules 1734 and program data 1736. All or portions of the operating system, applications, modules, and/or data can also be cached in the RAM 1712. It is appreciated that the claimed subject matter can be implemented with various commercially available operating systems or combinations of operating systems.

A user can enter commands and information into the computer 1702 through one or more wired/wireless input devices, e.g., a keyboard 1738 and a pointing device, such as a mouse 1740. Other input devices (not shown) can include a microphone, an IR remote control, a joystick, a game pad, a stylus pen, touch screen, or the like. These and other input devices are often connected to the processing unit 1704 through an input device interface 1742 that is coupled to the system bus 1708, but can be connected by other interfaces, such as a parallel port, an IEEE1374 serial port, a game port, a USB port, an IR interface, etc.

A monitor 1744 or other type of display device is also connected to the system bus 1708 via an interface, such as a video adapter 1746. In addition to the monitor 1744, a computer typically includes other peripheral output devices (not shown), such as speakers, printers, etc.

The computer 1702 can operate in a networked environment using logical connections via wired and/or wireless communications to one or more remote computers, such as a remote computer(s) 1748. The remote computer(s) 1748 can be a workstation, a server computer, a router, a personal computer, portable computer, microprocessor-based entertainment appliance, a peer device or other common network node, and typically includes many or all of the elements described relative to the computer 1702, although, for purposes of brevity, only a memory/storage device 1750 is illustrated. The logical connections depicted include wired/wireless connectivity to a local area network (LAN) 1752 and/or larger networks, e.g., a wide area network (WAN) 1754. Such LAN and WAN networking environments are commonplace in offices and companies, and facilitate enterprise-wide computer networks, such as intranets, all of which can connect to a global communications network, e.g., the Internet.

When used in a LAN networking environment, the computer 1702 is connected to the local network 1752 through a wired and/or wireless communication network interface or adapter 1756. The adapter 1756 can facilitate wired or wireless communication to the LAN 1752, which can also include a wireless access point disposed thereon for communicating with the wireless adapter 1756.

When used in a WAN networking environment, the computer 1702 can include a modem 1758, or is connected to a communications server on the WAN 1754, or has other means for establishing communications over the WAN 1754, such as by way of the Internet. The modem 1758, which can be internal or external and a wired or wireless device, is connected to the system bus 1708 via the serial port interface 1742. In a networked environment, program modules depicted relative to the computer 1702, or portions thereof, can be stored in the remote memory/storage device 1750. It will be appreciated that the network connections shown are exemplary and other means of establishing a communications link between the computers can be used.

The computer 1702 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least WiFi and Bluetooth® wireless technologies. Thus, the communication can be a predefined structure as with a conventional network or simply an ad hoc communication between at least two devices.

WiFi, or Wireless Fidelity, allows connection to the Internet from a couch at home, a bed in a hotel room, or a conference room at work, without wires. WiFi is a wireless technology similar to that used in a cell phone that enables such devices, e.g., computers, to send and receive data indoors and out; anywhere within the range of a base station. WiFi networks use radio technologies called IEEE802.11 (a, b, g, n, etc.) to provide secure, reliable, fast wireless connectivity. A WiFi network can be used to connect computers to each other, to the Internet, and to wired networks (which use IEEE802.3 or Ethernet). WiFi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 17BaseT wired Ethernet networks used in many offices.

Figure 18:
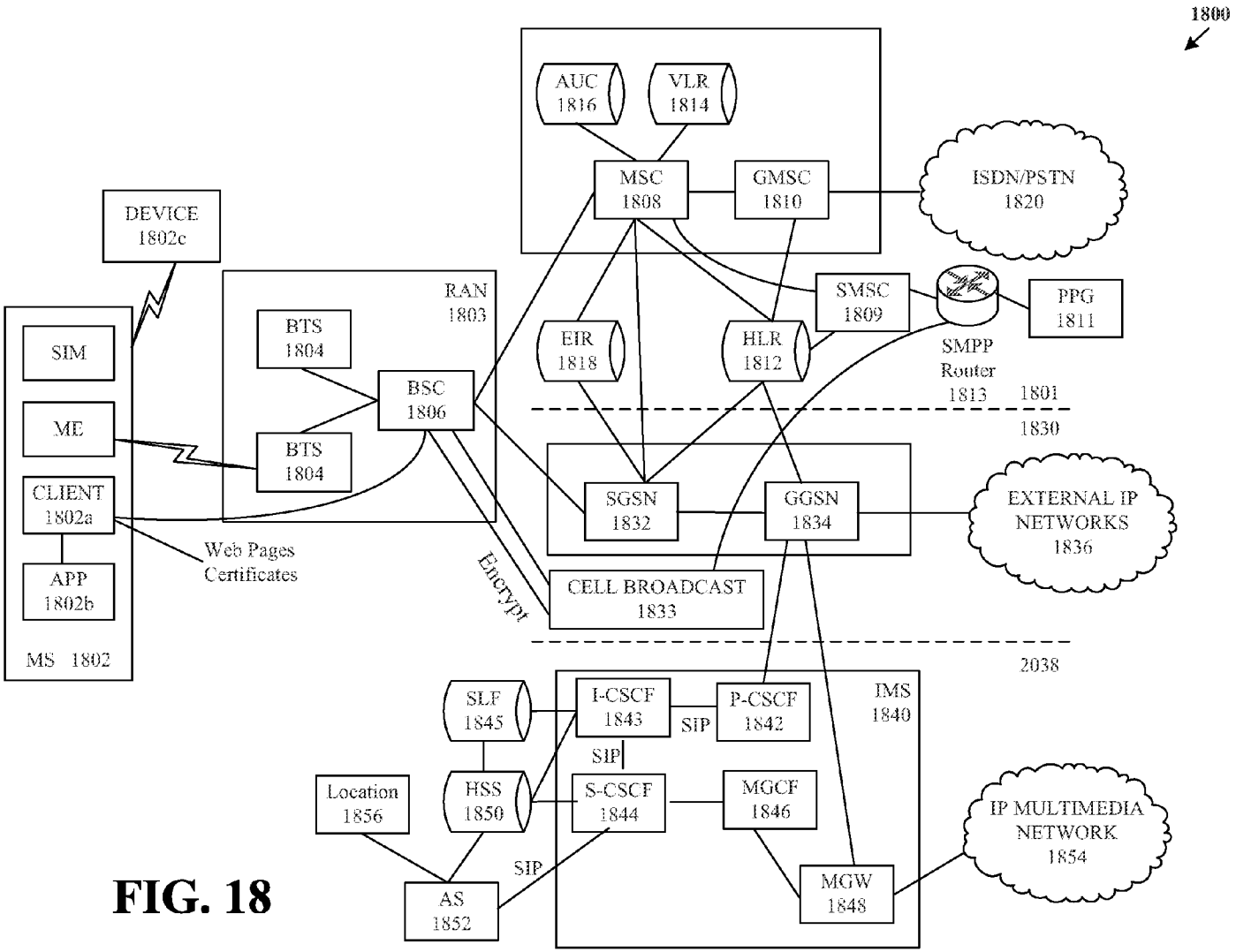
FIG. 18 various networks in accordance with the subject invention including a GSM/GPRS/IP multimedia network architecture that includes a GSM core network, a GPRS network and an IP multimedia network.

Now turning to FIG. 18, such figure depicts a GSM/GPRS/IP multimedia network architecture 1800 that includes a GSM core network 1801, a GPRS network 1830 and an IP multimedia network 1838. The GSM core network 1801 includes a Mobile Station (MS) 1802, at least one Base Transceiver Station (BTS) 1804 and a Base Station Controller (BSC) 1806. The MS 1802 is physical equipment or Mobile Equipment (ME), such as a mobile phone or a laptop computer that is used by mobile subscribers, with a Subscriber identity Module (SIM). The SIM includes an International Mobile Subscriber Identity (IMSI), which is a unique identifier of a subscriber. The MS 1802 includes an embedded client 1802*a* that receives and processes messages received by the MS 1802. The embedded client 1802*a* can be implemented in JAVA and is discuss more fully below.

The embedded client 1802*a* communicates with an application 1802*b* that provides services and/or information to an end user. One example of the application can be navigation software that provides near real-time traffic information that is received via the embedded client 1802*a* to the end user. The navigation software can provide road conditions, suggest alternate routes, etc. based on the location of the MS 1802. Those of ordinary skill in the art understand that there are many different methods and systems of locating an MS 1802.

Alternatively, the MS 1802 and a device 1802*c* can be enabled to communicate via a short-range wireless communication link, such as BLUETOOTH. For example, a BLUETOOTH SIM Access Profile can be provided in an automobile (e.g., device 1802*c*) that communicates with the SIM in the MS 1802 to enable the automobile's communications system to pull information from the MS 1802. The BLUETOOTH communication system in the vehicle becomes an "embedded phone" that employs an antenna associated with the automobile. The result is improved reception of calls made in the vehicle. As one of ordinary skill in the art would recognize, an automobile is one example of the device 1802*c*. There can be an endless number of devices 1802*c* that use the SIM within the MS 1802 to provide services, information, data, audio, video, etc. to end users.

The BTS 1804 is physical equipment, such as a radio tower, that enables a radio interface to communicate with the MS. Each BTS can serve more than one MS. The BSC 1806 manages radio resources, including the BTS. The BSC can be connected to several BTSs. The BSC and BTS components, in combination, are generally referred to as a base station (BSS) or radio access network (RAN) 1803.

The GSM core network 1801 also includes a Mobile Switching Center (MSC) 1808, a Gateway Mobile Switching Center (GMSC) 1810, a Home Location Register (HLR) 1812, Visitor Location Register (VLR) 1814, an Authentication Center (AuC) 1818, and an Equipment Identity Register (EIR) 1816. The MSC 1808 performs a switching function for the network. The MSC also performs other functions, such as registration, authentication, location updating, handovers, and call routing. The GMSC 1810 provides a gateway between the GSM network and other networks, such as an Integrated Services Digital Network (ISDN) or Public Switched Telephone Networks (PSTNs) 1818. In other words, the GMSC 1810 provides interworking functionality with external networks.

The HLR 1812 is a database or component(s) that comprises administrative information regarding each subscriber registered in a corresponding GSM network. The HLR 1812 also includes the current location of each MS. The VLR 1814 is a database or component(s) that includes selected administrative information from the HLR 1812. The VLR includes information necessary for call control and provision of subscribed services for each MS currently located in a geographical area controlled by the VLR. The HLR 1812 and the VLR 1814, together with the MSC 1808, provide the call routing and roaming capabilities of GSM. The AuC 1816 provides the parameters needed for authentication and encryption functions. Such parameters allow verification of a subscriber's identity. The EIR 1818 stores security-sensitive information about the mobile equipment.

A Short Message Service Center (SMSC) 1809 allows one-to-one Short Message Service (SMS) messages to be sent to/from the MS 1802. A Push Proxy Gateway (PPG) 1811 is used to "push" (e.g., send without a synchronous request) content to the MS 1802. The PPG 1811 acts as a proxy between wired and wireless networks to facilitate pushing of data to the MS 1802. A Short Message Peer to Peer (SMPP) protocol router 1813 is provided to convert SMS-based SMPP messages to cell broadcast messages. SMPP is a protocol for exchanging SMS messages between SMS peer entities such as short message service centers. It is often used to allow third parties, e.g., content suppliers such as news organizations, to submit bulk messages.

To gain access to GSM services, such as speech, data, and short message service (SMS), the MS first registers with the network to indicate its current location by performing a location update and IMSI attach procedure. The MS 1802 sends a location update including its current location information to the MSC/VLR, via the BTS 1804 and the BSC 1806. The location information is then sent to the MS's HLR. The HLR is updated with the location information received from the MSC/VLR. The location update also is performed when the MS moves to a new location area. Typically, the location update is periodically performed to update the database as location-updating events occur.

The GPRS network 1830 is logically implemented on the GSM core network architecture by introducing two packet-switching network nodes, a serving GPRS support node (SGSN) 1832, a cell broadcast and a Gateway GPRS support node (GGSN) 1834. The SGSN 1832 is at the same hierarchical level as the MSC 1808 in the GSM network. The SGSN controls the connection between the GPRS network and the MS 1802. The SGSN also keeps track of individual MS's locations and security functions and access controls.

A Cell Broadcast Center (CBC) 1833 communicates cell broadcast messages that are typically delivered to multiple users in a specified area. Cell Broadcast is one-to-many geographically focused service. It enables messages to be communicated to multiple mobile phone customers who are located within a given part of its network coverage area at the time the message is broadcast.

The GGSN 1834 provides a gateway between the GPRS network and a public packet network (PDN) or other IP networks 1836. That is, the GGSN provides interworking functionality with external networks, and sets up a logical link to the MS through the SGSN. When packet-switched data leaves the GPRS network, it is transferred to an external TCP-IP network 1836, such as an X.25 network or the Internet. In order to access GPRS services, the MS first attaches itself to the GPRS network by performing an attach procedure. The MS then activates a packet data protocol (PDP) context, thus activating a packet communication session between the MS, the SGSN, arc the GGSN.

In a GSM/GPRS network, GPRS services and GSM services can be used in parallel. The MS can operate in one three classes: class A, class B, and class C. A class A MS can attach to the network for both GPRS services and GSM services simultaneously. A class A MS also supports simultaneous operation of GPRS services and GSM services. For example, class A mobiles can receive GSM voice/data/SMS calls and GPRS data calls at the same time. A class B MS can attach to the network for both GPRS services and GSM services simultaneously. However, a class B MS does not support simultaneous operation of the GPRS services and GSM services. That is, a class B MS can only use one of the two services at a given time. A class C MS can attach for only one of the GPRS services and GSM services at a time. Simultaneous attachment and operation of GPRS services and GSM services is not possible with a class C MS.

A GPRS network 1830 can be designed to operate in three network operation modes (NOM1, NOM2 and NOM3). A network operation mode of a GPRS network is indicated by a parameter in system information messages transmitted within a cell. The system information messages dictates a MS where to listen for paging messages and how signal towards the network. The network operation mode represents the capabilities of the GPRS network. In a NOM1 network, a MS can receive pages from a circuit switched domain (voice call) when engaged in a data call. The MS can suspend the data call or take both simultaneously, depending on the ability of the MS. In a NOM2 network, a MS cannot receive pages from a circuit switched domain when engaged in a data call, since the MS is receiving data and is not listening to a paging channel. In a NOM3 network, a MS can monitor pages for a circuit switched network while received data and vise versa.

The IP multimedia network 1838 was introduced with 3GPP Release 5, and includes an IP multimedia subsystem (IMS) 1840 to provide rich multimedia services to end users. A representative set of the network entities within the IMS 1840 are a call/session control function (CSCF), a media gateway control function (MGCF) 1846, a media gateway (MGW) 1848, and a master subscriber database, called a home subscriber server (HSS) 1850. The HSS 1850 can be common to the GSM network 1801, the GPRS network 1830 as well as the IP multimedia network 1838.

The IP multimedia system 1840 is built around the call/session control function, of which there are three types: an interrogating CSCF (I-CSCF) 1843, a proxy CSCF (P-CSCF) 1842, and a serving CSCF (S-CSCF) 1844. The P-CSCF 1842 is the MS's first point of contact with the IMS 1840. The P-CSCF 1842 forwards session initiation protocol (SIP) messages received from the MS to an SIP server in a home network (and vice versa) of the MS. The P-CSCF 1842 can also modify an outgoing request according to a set of rules defined by the network operator (for example, address analysis and potential modification).

The I-CSCF 1843 forms an entrance to a home network and hides the inner topology of the home network from other networks and provides flexibility for selecting an S-CSCF. The I-CSCF 1843 can contact a subscriber location function (SLF) 1845 to determine which HSS 1850 to use for the particular subscriber, if multiple HSS's 1850 are present. The S-CSCF 1844 performs the session control services for the MS 1802. This includes routing originating sessions to external networks and routing terminating sessions to visited networks. The S-CSCF 1844 also decides whether an application server (AS) 1852 is required to receive information on an incoming SIP session request to ensure appropriate service handling. This decision is based on information received from the HSS 1850 (or other sources, such as an application server 1852). The AS 1852 also communicates to a location server 1856 (e.g., a Gateway Mobile Location Center (GMLC)) that provides a position (e.g., latitude/longitude coordinates) of the MS 1802.

The HSS 1850 includes a subscriber profile and keeps track of which core network node is currently handling the subscriber. It also supports subscriber authentication and authorization functions (AAA). In networks with more than one HSS 1850, a subscriber location function provides information on the HSS 1850 that includes the profile of a given subscriber.

The MGCF 1846 provides interworking functionality between SIP session control signaling from the IMS 1840 and ISUP/BICC call control signaling from the external GSTN networks (not shown). It also controls the media gateway (MGW) 1848 that provides user-plane inter-working functionality (e.g., converting between AMR- and PCM-coded voice). The MGW 1848 also communicates with other IP multimedia networks 1854.

Figure 19:
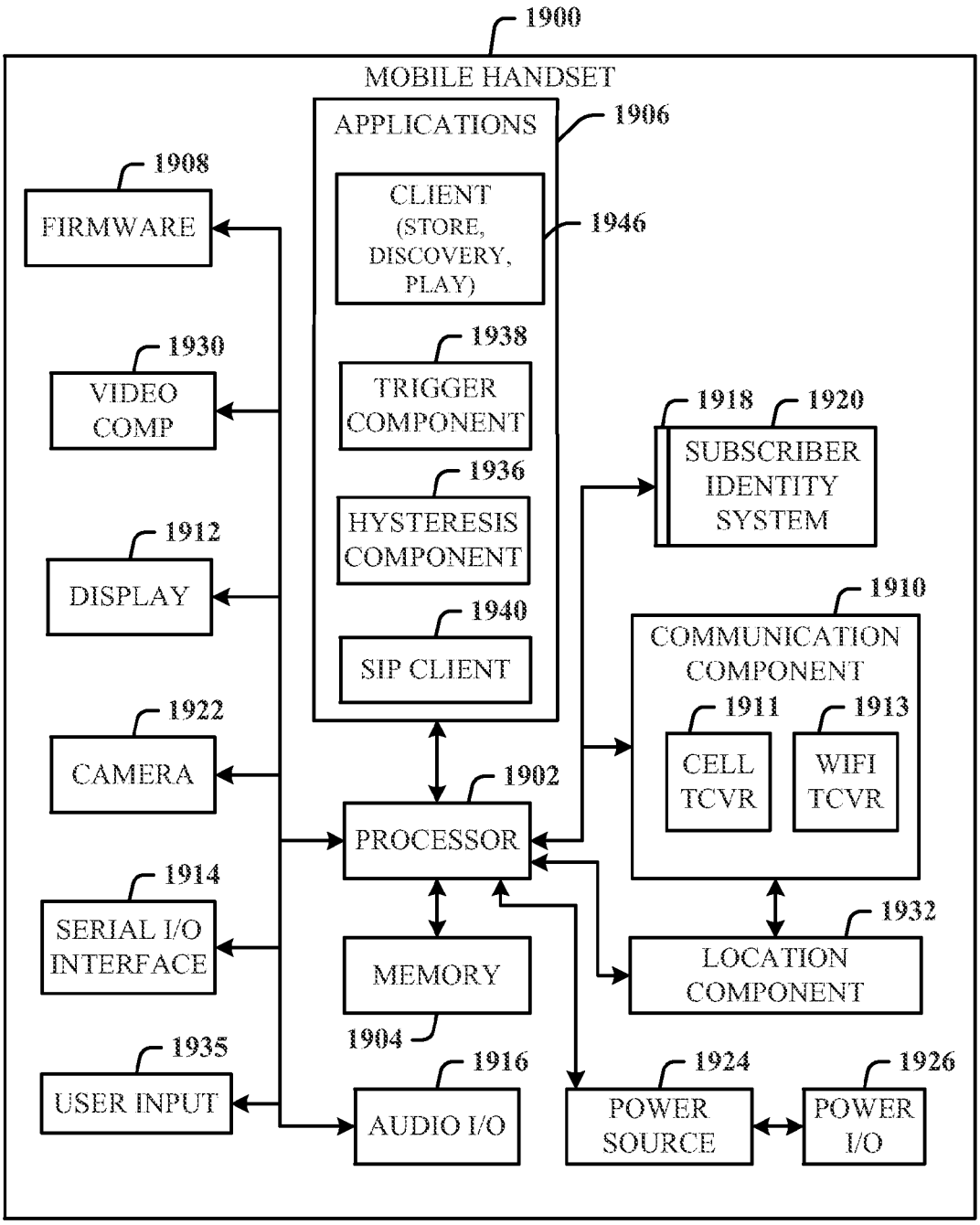
FIG. 19 illustrates a schematic block diagram of an exemplary device capable of employing the subject system in accordance with some embodiments of the invention.

FIG. 19 illustrates a schematic block diagram of an exemplary device 1900 capable of employing the subject system in accordance with some embodiments of the invention. The device is a mobile handset 1900 In order to provide additional context for various aspects thereof, FIG. 19 and the following discussion are intended to provide a brief, general description of a suitable environment 1900 in which the various aspects can be implemented. While the description includes a general context of computer-executable instructions, those skilled in the art will recognize that the innovation also can be implemented in combination with other program modules and/or as a combination of hardware and software.

Generally, applications (e.g., program modules) can include routines, programs, components, data structures, etc., that perform particular tasks or implement particular abstract data types. Moreover, those skilled in the art will appreciate that the inventive methods can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated devices.

A computing device can typically include a variety of computer-readable media. Computer-readable media can be any available media that can be accessed by the computer and includes both volatile and non-volatile media, removable and non-removable media. By way of example and not limitation, computer-readable media can comprise computer storage media and communication media. Computer storage media includes both volatile and non-volatile, removable and non-removable media implemented in any method or technology for storage of information such as computer-readable instructions, data structures, program modules or other data. Computer storage media can include, but is not limited to, RAM, ROM, EEPROM, flash memory or other memory technology, CD-ROM, digital video disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

The handset 1900 includes a processor 1902 for controlling and processing all onboard operations and functions. A memory 1904 interfaces to the processor 1902 for storage of data and one or more applications 1906 (e.g., a video player software, user feedback component software, . . . ). Other applications can include voice recognition of predetermined voice commands that facilitate initiation of the user feedback signals. The applications 1906 can be stored in the memory 1904 and/or in a firmware 1908, and executed by the processor 1902 from either or both the memory 1904 or/and the firmware 1908. The firmware 1908 can also store startup code for execution in initializing the handset 1900. A communications component 1910 interfaces to the processor 1902 to facilitate wired/wireless communication with external systems, e.g., cellular networks, VoIP networks, and so on. Here, the communications component 1910 can also include a suitable cellular transceiver 1911 (e.g., a GSM transceiver) and an unlicensed transceiver 1913 (e.g., WiFi, WiMax) for corresponding signal communications. The handset 1900 can be a device such as a cellular telephone, a PDA with mobile communications capabilities, and messaging-centric devices. The communications component 1910 also facilitates communications reception from terrestrial radio networks (e.g., broadcast), digital satellite radio networks, and Internet-based radio services networks.

The handset 1900 includes a display 1912 for displaying text, images, video, telephony functions (e.g., a Caller ID function), setup functions, and for user input. The display 1912 can also accommodate the presentation of multimedia content (e.g., music metadata, messages, wallpaper, graphics, . . . ). A serial I/O interface 1914 is provided in communication with the processor 1902 to facilitate wired and/or wireless serial communications (e.g., USB, and/or IEEE 1394) through a hardwire connection, and other serial input devices (e.g., a keyboard, keypad, and mouse). This supports updating and troubleshooting the handset 1900, for example. Audio capabilities are provided with an audio I/O component 1916, which can include a speaker for the output of audio signals related to, for example, indication that the user pressed the proper key or key combination to initiate the user feedback signal. The audio I/O component 1916 also facilitates the input of audio signals through a microphone to record data and/or telephony voice data, and for inputting voice signals for telephone conversations.

The handset 1900 can include a slot interface 1918 for accommodating a SIC (Subscriber Identity Component) in the form factor of a card Subscriber Identity Module (SIM) or universal SIM 1918, and interfacing the SIM card 1918 with the processor 1902. However, it is to be appreciated that the SIM card 918 can be manufactured into the handset 1900, and updated by downloading data and software thereinto.

The handset 1900 can process IP data traffic through the communication component 1910 to accommodate IP traffic from an IP network such as, for example, the Internet, a corporate intranet, a home network, a person area network, etc., through an ISP or broadband cable provider. Thus, VoIP traffic can be utilized by the handset 1900 and IP-based multimedia content can be received in either an encoded or decoded format.

A video processing component 1922 (e.g., a camera) can be provided for decoding encoded multimedia content. The handset 1900 also includes a power source 1924 in the form of batteries and/or an AC power subsystem, which power source 1924 can interface to an external power system or charging equipment (not shown) by a power I/O component 1926.

The handset 1900 can also include a video component 1930 for processing video content received and, for recording and transmitting video content. A location tracking component 932 facilitates geographically locating the handset 1900. As described hereinabove, this can occur when the user initiates the feedback signal automatically or manually. A user input component 1934 facilitates the user initiating the quality feedback signal. The input component can include such conventional input device technologies such as a keypad, keyboard, mouse, stylus pen, and touch screen, for example.

Referring again to the applications 1906, a hysteresis component 1936 facilitates the analysis and processing of hysteresis data, which is utilized to determine when to associate with the access point. A software trigger component 1938 can be provided that facilitates triggering of the hysteresis component 1938 when the WiFi transceiver 1913 detects the beacon of the access point. A SIP client 940 enables the handset 1900 to support SIP protocols and register the subscriber with the SIP registrar server. The applications 1906 can also include a client 1942 that provides at least the capability of discovery, play and store of multimedia content, for example, music.

The handset 1900, as indicated above related to the communications component 910, includes an indoor network radio transceiver 1913 (e.g., WiFi transceiver). This function supports the indoor radio link, such as IEEE 802.11, for the dual-mode GSM handset 1900. The handset 1900 can accommodate at least satellite radio services through a handset that can combine wireless voice and digital radio chipsets into a single handheld device.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pill organizer, comprising:

at least two compartments that house pills, wherein each compartment can couple to another compartment via at least one wall to form a row of compartments, each of the compartments defined by a housing comprising a top, a bottom and at least two sidewalls, wherein each of the compartments further comprise an interior receptacle for containing the pills, the interior receptacle having a semi-ellipsoid shape, and wherein each of the compartments can couple to one another compartment via at least one sidewall to form a row of compartments, and the at least two compartments further comprise electronic circuitry that facilitate at least one of: wired communications, wireless communications, sensing, lid control, lighting, or generating and sending notifications, an electronic base component permanently attached above a fixed primary row of compartments;

an interface component comprising at least one of: an LCD screen, a touch LCD screen, buttons, dials, a keypad or a speaker;

a processor that directs and controls functionality of the pill organizer; and a communication component which provides wired or wireless communication to at least one of another device or an outside network.

2. The pill organizer of claim 1 wherein at least one of the at least two compartments further comprises a sensor, the sensor detects at least one of a physical parameter associated with the at least one of the at least two compartments or user interaction therewith.

3. The pill organizer of claim 2, the physical parameters comprise at least one of: number of pills in a compartment the; identity of pills in a compartment; whether a compartment is open or closed; whether a compartment is attached or detached; or number and sequence of attached or detached compartments.

4. The pill organizer of claim 1 wherein each compartment further comprises an LCD screen integrated within a lid on the top of the compartment, or a light on the top of a compartment.

* * * * *